US006835521B2

(12) United States Patent
Tsuji et al.

(10) Patent No.: US 6,835,521 B2
(45) Date of Patent: Dec. 28, 2004

(54) PROCESS FOR PRODUCING TONER PARTICLES, AND TONER

(75) Inventors: Yoshinori Tsuji, Shizuoka (JP); Toshiyuki Ugai, Ibaraki (JP); Akira Hashimoto, Shizuoka (JP); Hidekazu Fumita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 9 days.

(21) Appl. No.: 10/349,968

(22) Filed: Jan. 24, 2003

(65) Prior Publication Data

US 2003/0224276 A1 Dec. 4, 2003

(30) Foreign Application Priority Data

Jun. 3, 2002 (JP) ..... 2002-160979

(51) Int. Cl.[7] ..... G03G 9/08
(52) U.S. Cl. ..... 430/137.17; 430/137.15
(58) Field of Search ..... 430/137.17, 137.15

(56) References Cited

U.S. PATENT DOCUMENTS 5,476,745 A * 12/1995 Nakamura et al. ..... 430/137.17
6,309,788 B1 10/2001 Tsuji et al. ..... 430/137.17
2002/0031714 A1 3/2002 Fumita et al. ..... 430/137.17

FOREIGN PATENT DOCUMENTS

| | | |
|---|---|---|
| JP | 59-61842 | 4/1984 |
| JP | 8-160662 | 6/1996 |
| JP | 10-207122 | 8/1998 |

OTHER PUBLICATIONS

Brandrup, et al.; "The Glass Transition temperatures of Polymers", Polymer Handbook, 2$^{nd}$ Ed.; pp. (II–139)—(III–192) (1971).

* cited by examiner

*Primary Examiner*—Christopher RoDee
(74) *Attorney, Agent, or Firm*—Fitzpatrick, Cella, Harper & Scinto

(57) ABSTRACT

To provide a process for producing toner particles in a good efficiency which have less residue of monomers and less other organic volatile components, the process has a polymerization step of polymerizing a polymerizable monomer composition containing at least a polymerizable monomer, in a vessel holding therein an aqueous medium, wherein a high-temperature saturated steam with a temperature higher than 100° C. is introduced into the aqueous medium held in the vessel, at the latter half of polymerization or after the polymerization has been completed, to remove at least organic volatile components from toner particles having at least a binder resin and a colorant.

19 Claims, 6 Drawing Sheets

PROCESS FOR PRODUCING TONER PARTICLES, AND TONER

BACKGROUND OF THE INVENTION

1. Field of the Invention

This invention relates to a toner used in an image-forming process such as electrophotography, electrostatic recording, electrostatic printing or toner jet recording, and to a process for producing toner particles constituting such a toner.

2. Related Background Art

In electrophotography, copied images or printed images are commonly obtained by utilizing a photosensitive member comprised of a photoconductive material, and by forming an electrostatic latent image on the photosensitive member by various means, subsequently developing the latent image by the use of a toner to form a toner image, and transferring via, or not via, an intermediate transfer member the toner image to a transfer material such as paper as occasion calls, and thereafter fixing the toner image to a transfer material by the action of heat, pressure or heat-and-pressure.

As toner productions processes, they are roughly grouped into a pulverization process and a polymerization process. For example, in the process of producing toners by pulverization, at least a binder resin and a colorant are used, and optionally a charge control agent for controlling the triboelectric charge characteristics of toner particles and a release agent are added and mixed. The mixture obtained is melt-kneaded, and the resultant kneaded product is cooled to solidify, which is then made into fine particles by a pulverization means, optionally followed by classification to have a desired particle size distribution to produce toner particles.

As the polymerization process, available are a method in which toner particles are directly produced by suspension polymerization as disclosed in Japanese Patent Application Laid-Open No. 59-61842, and a method of emulsion polymerization in which a monomer composition containing polymerizable monomers, a polymerization initiator, a surface-active agent and further optionally a cross-linking agent, a chain transfer agent and other additives is dispersed in an aqueous medium by means of a suitable stirrer and is simultaneously subjected to polymerization to obtain emulsified resin particles having the desired particle diameter, in the meantime of which a colorant is uniformly dispersed in an aqueous medium containing a surface-active agent, and the resultant dispersion is associated (agglomeration and fusion) with the above emulsified resin particles to obtain toner particles. The toner particles obtained by such polymerization are optionally classified to make adjustments to their desired particle size distribution. The toner particles obtained by such polymerization enable a low-softening substance such as wax as a release agent to be encapsulated in toner particles in a larger quantity than in the pulverization process, and hence have an advantage that the toner particles obtained have superior anti-offset properties.

On the other hand, in the step of polymerization, it is difficult to make the polymerizable monomers react in its entirety and there has been a problem that unreacted polymerizable monomers remain in toner particles. Especially in the case of toner particles produced by suspension polymerization, components having a possibility of inhibiting polymerization reaction as exemplified by a pigment, a charge control agent and/or a magnetic material are present in the polymerizable monomer composition, and hence the unreacted polymerizable monomers tend to remain. This tendency has been remarkable especially when a magnetic material treated with a coupling agent is used.

Where a polymerization initiator is used when the binder resin is produced, a by-product derived from the polymerization initiator may also inevitably be formed. In some cases, the total quantity of such a by-product may unwantedly come larger than the quantity of the unreacted polymerizable monomers.

Organic volatile components such as the unreacted polymerizable monomer and the by-product which are present in the toner particles in a large quantity may lower the fluidity of toner to make work environment bad or may give off an unpleasant smell. Also, where an organic semiconductor is used as a photosensitive member, the use of a toner having toner particles much containing such organic volatile components tends to cause a phenomenon of melt adhesion of toner to the photosensitive member, and problems caused by phenomena of deterioration of the photosensitive member as exemplified by memory ghost and blurred images may arise.

Especially in recent years, as copying machines and printers are made compact and personal, restrictions are more placed on apparatus and a greater load is imposed on the above problems. Also, there is an increasing interest in environment, and it is demanded to reduce any volatile components coming from toner particles, generated in heat-and-pressure fixing assemblies.

Methods by which the total amount of volatile components is made smaller in toner particles may include a method in which they are washed with a highly volatile organic solvent not dissolving binder resins but capable of dissolving the organic volatile components such as unreacted polymerizable monomers and/or reaction by-products; a method in which they are washed with an acid or an alkali; and a method in which a solvent component not dissolving binder resins or a foaming agent is mixed in the binder resin and the toner particles to be obtained are made porous to enlarge the area where the inside volatile components volatilize. However, it is difficult to select solvents because some constituents of the toner particles may dissolve out or any solvent component may remain. Accordingly, in order to make the total amount of volatile components smaller, many studies are made on making treatment to remove them in a drying step after the polymerization for forming the toner particles or binder resin has been completed.

Stated specifically, the following methods are known in the art.

(1) A method in which toner particles are dried by vacuum drying after a dehydration step (Japanese Patent Application Laid-Open No. 8-160662).

(2) A method in which toner particles are vacuum-dried while a gas is injected, after a dehydration step (Japanese Patent Application Laid-Open No. 10-207122).

These methods enable removal of volatile substances, but are undesirable because the rate of reduction of the volatile substances is so low that it may take a long time in order to make the total amount of organic volatile components not more than 500 ppm, preferably not more than 400 ppm, and more preferably not more than 300 ppm, taking account of environment safety. Taking a long time necessitates to use much energy, and hence the production cost for toner particles may greatly increase. Besides, since it takes a long drying time, it consequently follows that thermal and mechanical damage due to stirring is caused to the toner particles in a vacuum dryer. This has tended to affect the surface state of toner particles and tended to produce agglomerates of toner particles.

SUMMARY OF THE INVENTION

An object of the present invention is to provide toner particles having solved the above problems, and a process for producing such toner particles.

Another object of the present invention is to provide a process for producing toner particles promising superior developing performance and containing less organic volatile components, and a toner having such toner particles.

Still another object of the present invention is to provide a process for producing toner particles promising superior developing performance and having monomers in a small residue, and a toner having such toner particles.

A further object of the present invention is to provide a process for producing toner particles in a good efficiency which have monomers in a small residue and contain less other organic volatile components, and a toner having such toner particles.

A still further object of the present invention is to provide a process for producing toner particles in a good efficiency which have high fluidity, have good anti-blocking properties and can contribute to formation of good-quality images, and a toner having such toner particles.

The present invention provides a process for producing toner particles which has a polymerization step of polymerizing a polymerizable monomer composition containing at least a polymerizable monomer, in a vessel holding therein an aqueous medium, wherein;

a high-temperature saturated steam with a temperature higher than 100° C. is introduced into the aqueous medium held in the vessel, at the latter half of polymerization or after the polymerization has been completed, to remove at least organic volatile components from toner particles having at least a binder resin and a colorant.

The present invention further provides a toner having toner particles containing at least a binder resin and a colorant, wherein;

the binder resin contains as a chief component a vinyl resin selected from the group consisting of a styrene polymer, a polymer of a styrene derivative, a styrene-acrylate copolymer, a styrene-methacrylate copolymer, a styrene-acrylate-methacrylate copolymer and a mixture of any of these; the total amount of organic volatile components contained in the toner, in terms of toluene based on the weight of the toner is 500 ppm or less and the residue of vinyl monomers contained in the toner, in terms of toluene based on the weight of the toner is 75 ppm or less, according to the analysis of the organic volatile components by the head space method at a heating temperature of 150° C.; and the toner has an average circularity of 0.950 or more.

DESCRIPTION OF THE PREFERRED EMBODIMENTS

As a result of extensive studies made in order to solve the above problems the related background art has had, the present inventors have discovered that the removing of polymerizable monomers and organic volatile components from toner particles in a good efficiency is greatly related with the temperature inside the polymerization vessel at the latter half of polymerization or after the polymerization has been completed, the manner of heating the contents in the vessel, and the quantity of a fraction distilled off from the interior of the polymerization vessel.

The present invention is described in detail by giving preferred embodiments of the present invention.

Figure 1:
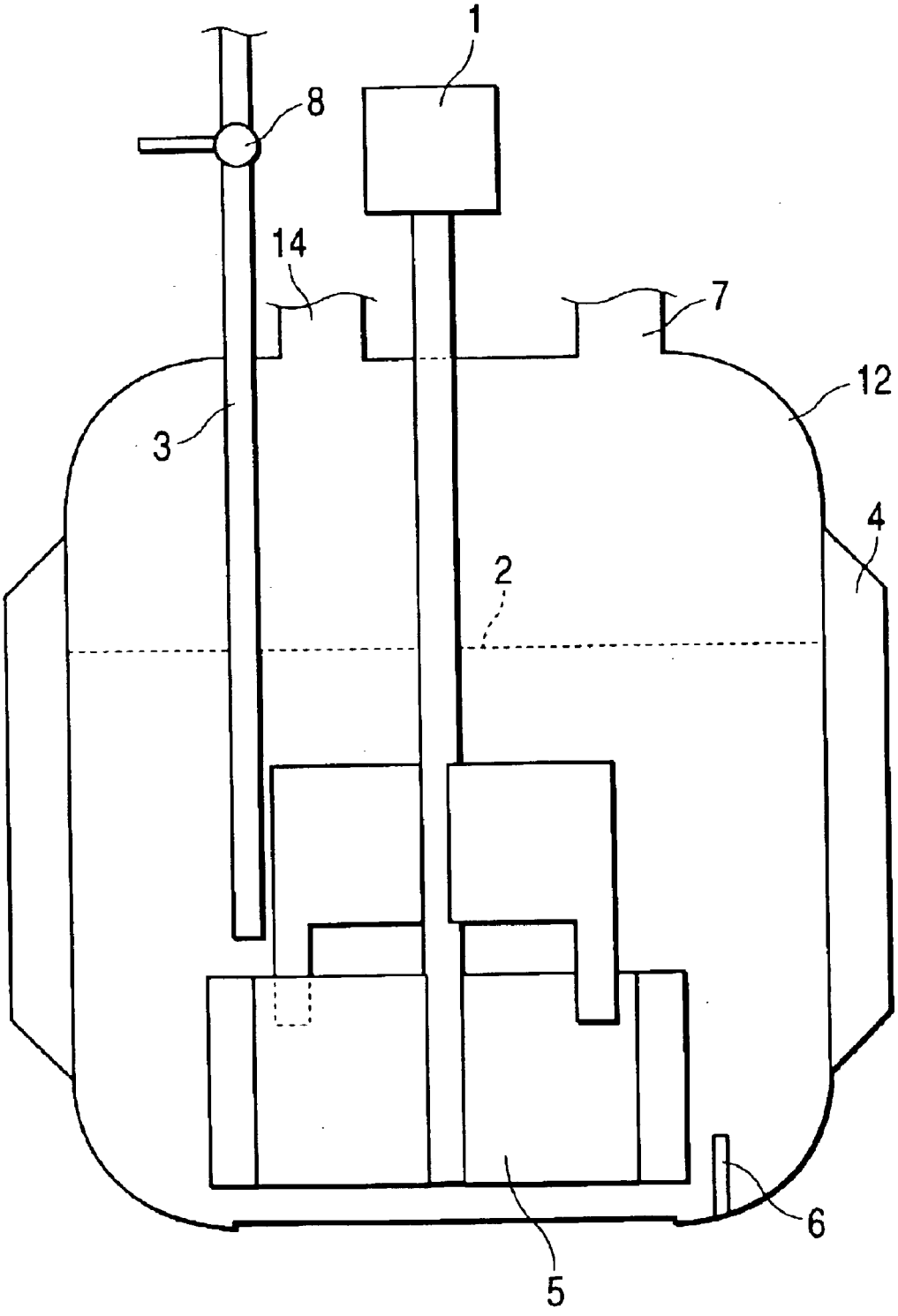
FIG. 1 illustrates an example of a polymerization vessel used in the present invention.
Figure 2:
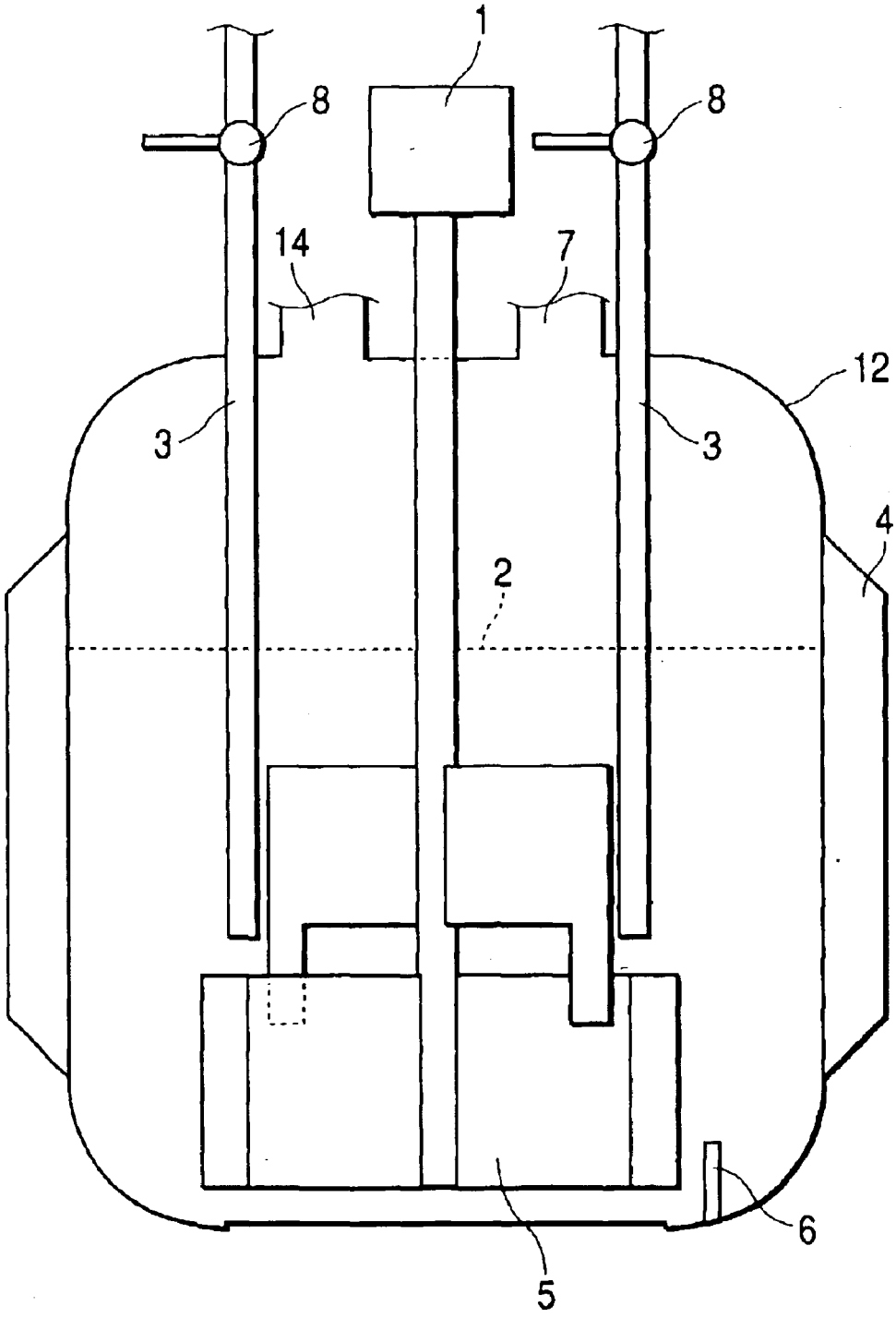
FIG. 2 illustrates another example of a polymerization vessel used in the present invention.
Figure 3:
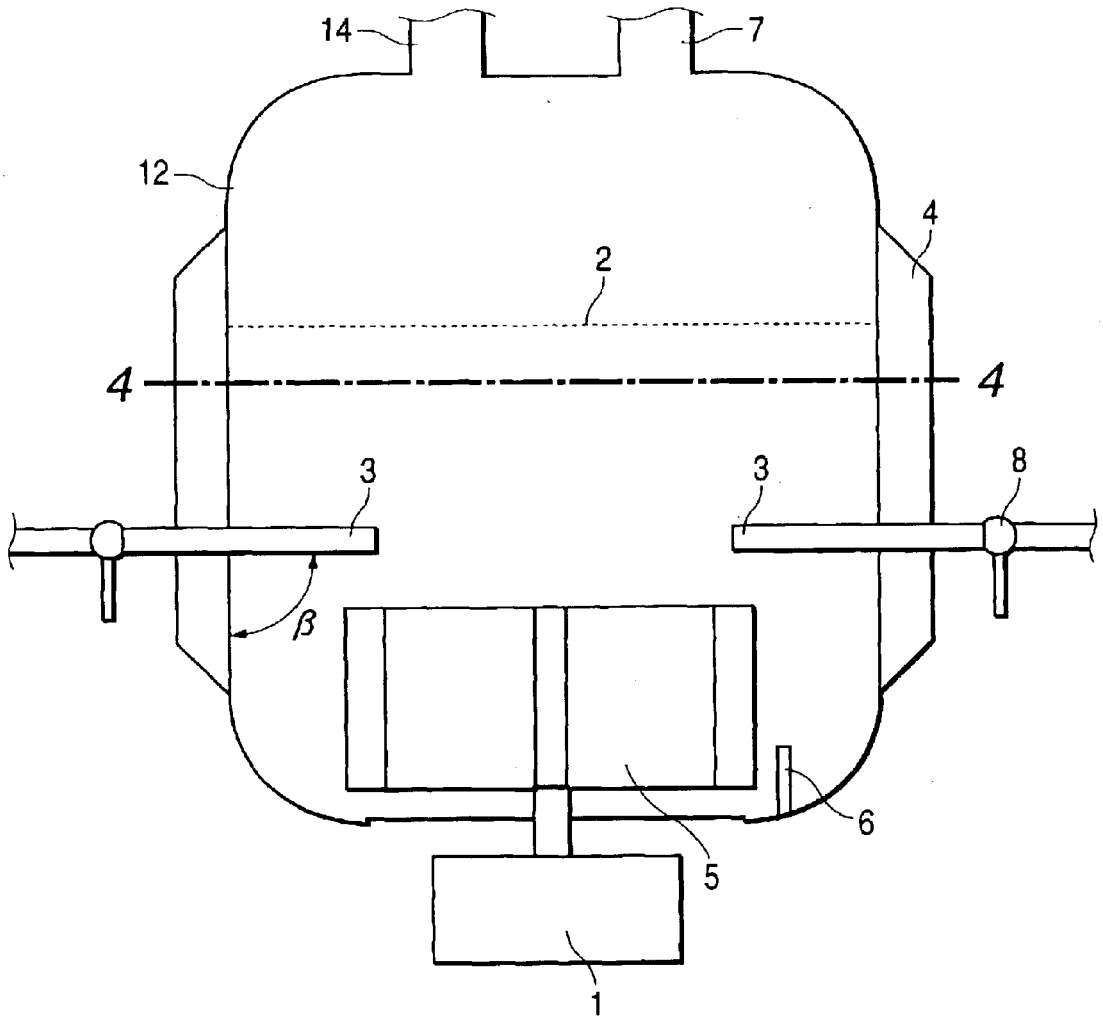
FIG. 3 illustrates still another example of a polymerization vessel used in the present invention.
Figure 4:
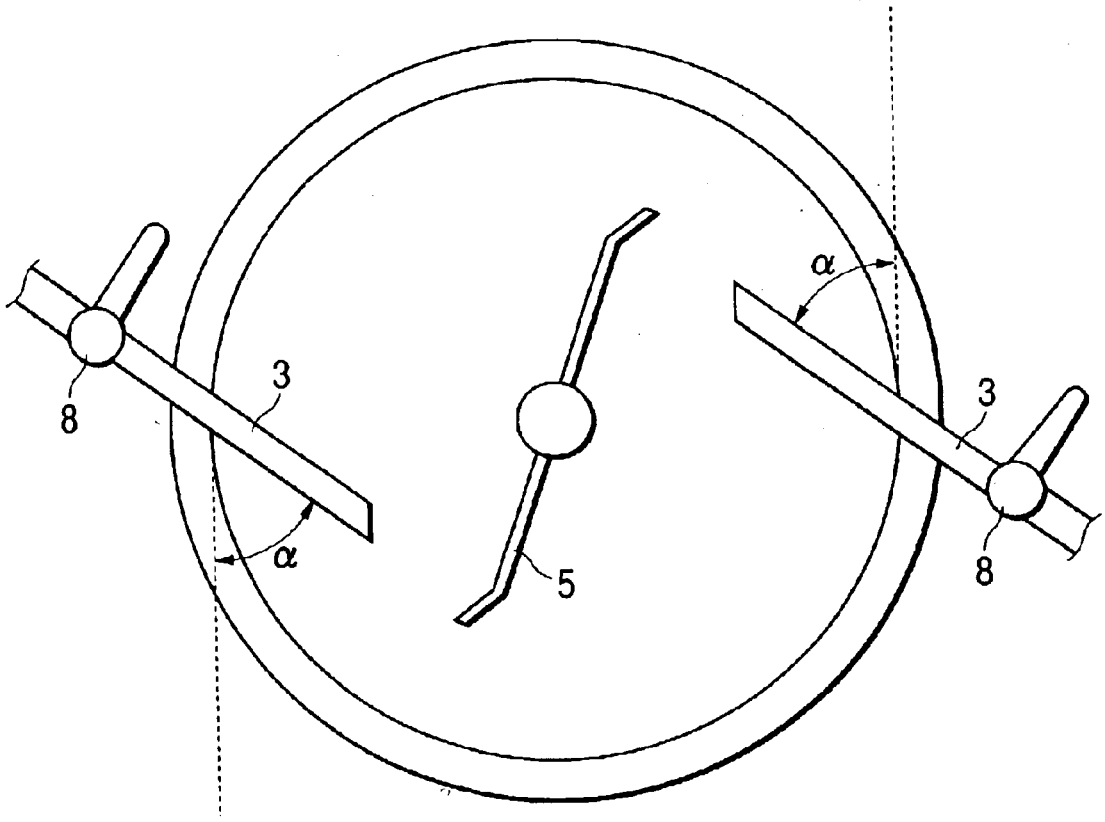
FIG. 4 is a sectional view of the FIG. 3 polymerization vessel, cut along the line 4—4 in FIG. 3.
Figure 5:
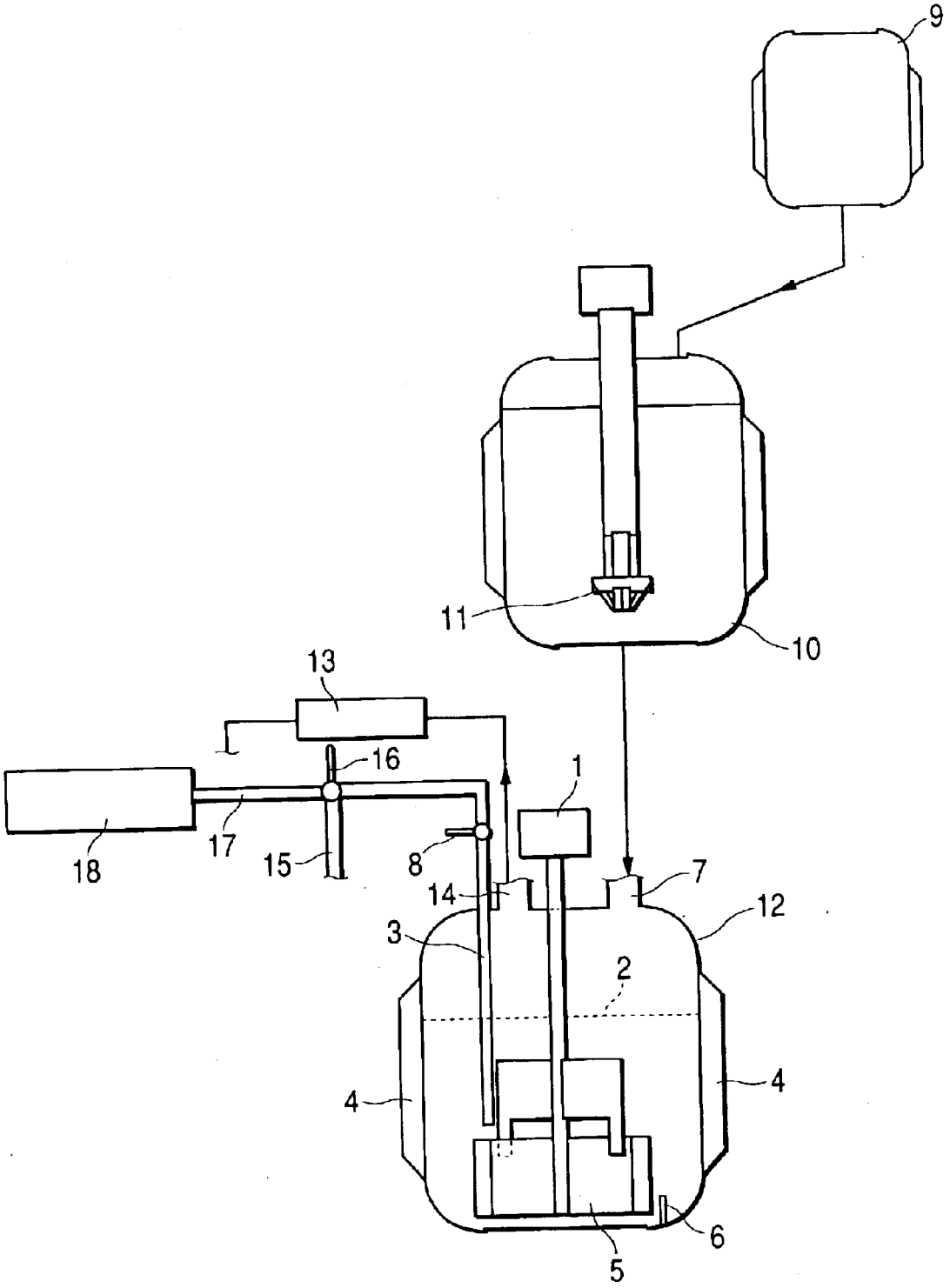
FIG. 5 illustrates an example of a system used in the present invention.
Figure 6:
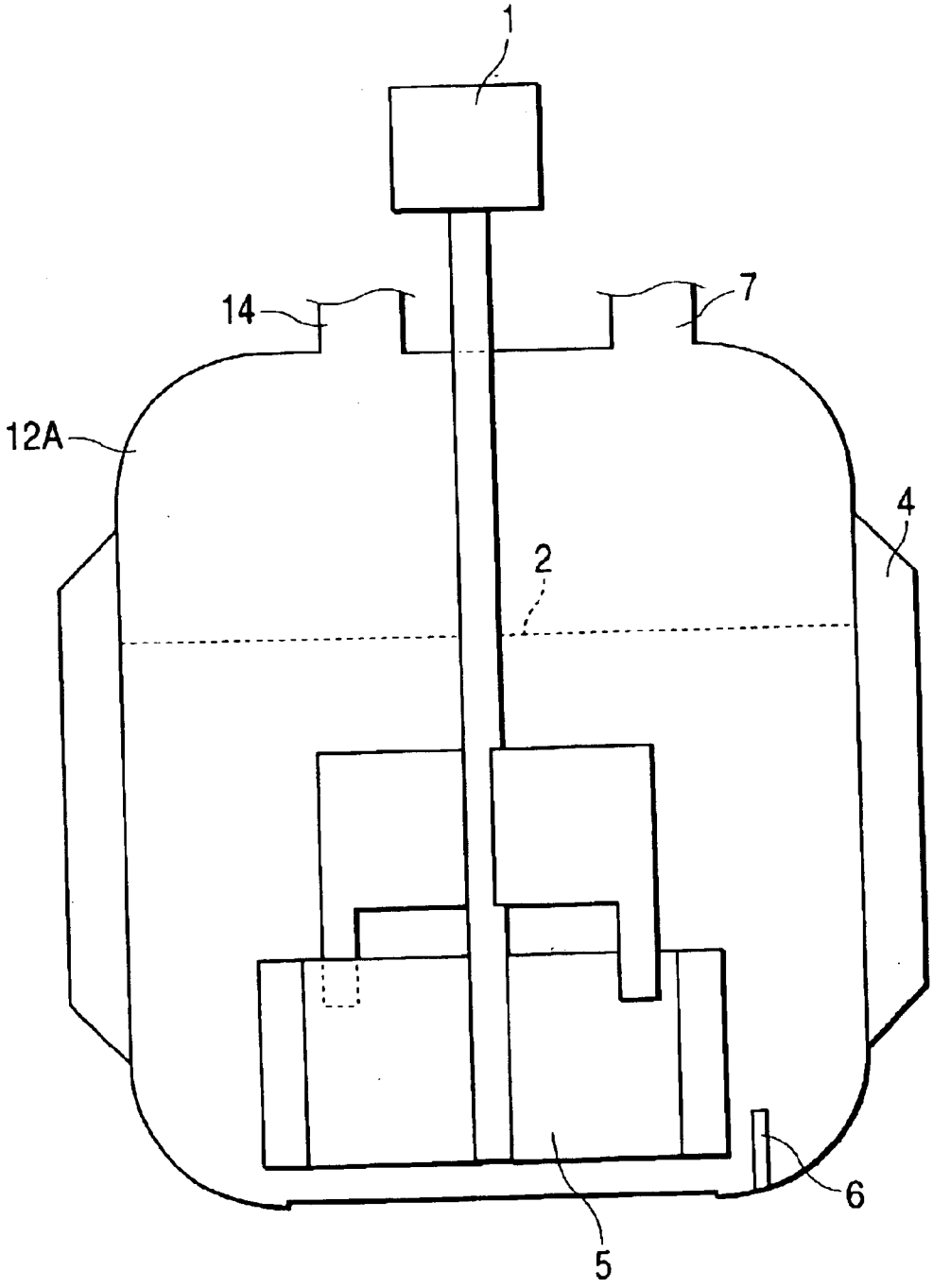
FIG. 6 illustrates an example of a polymerization vessel used in a conventional production process.

FIGS. 1 to 3 schematically illustrate polymerization vessels used in the present invention. FIG. 4 is a sectional view along the line 4—4 in FIG. 3. FIG. 5 also illustrates an example of a system according to the present invention. These show examples, to which the present invention is by no means limited.

In FIG. 1 (also in FIGS. 2 to 5), reference numeral 1 denotes a stirring-blade drive unit; 2, the liquid surface of the contents in polymerization vessel 12; 3, a steam feed pipe through which a saturated steam with a temperature higher than 100° C. is introduced; 4, a jacket for controlling the temperature of the contents in the vessel 12; 5, a stirring blade; 6, a thermometer for measuring the temperature inside the vessel 12; 7, a liquid-feeding inlet through which a liquid is introduced into the vessel 12; 8, a steam feed valve; and 14, a bent pipe. FIG. 2 shows an example of a polymerization vessel provided with a plurality of steam feed pipes 3. FIG. 3 shows an example of a polymerization vessel provided with a plurality of steam feed pipes 3 inside the liquid. In the vessel shown in FIG. 3, the stirring blade 5 need not necessarily be provided where the contents in the vessel can uniformly be stirred by the action of propellant force of the saturated steam introduced through the steam feed pipes 3. The steam feed pipes 3 may preferably be in the number of two to eight.

The polymerization vessels constructed as described above are each installed in a system shown in FIG. 5.

In the system shown in FIG. 5, a polymerizable monomer composition prepared in a dissolving vessel 9 which carries out a dissolving step is dispersed in an aqueous medium in a granulation vessel 10 which carries out granulation. The dispersion and granulation are carried out by stirring and dispersion for a certain time by the action of strong shear force, impact and turbulent flows produced between a high-speed revolving stirring blade built in a stirrer 11 and a screen which are provided inside the granulation vessel 10, thus microscopic-order particles of the polymerizable monomer composition are formed. The particles of the polymerizable monomer composition which have been thus formed are sent to the polymerization vessel 12 together with the aqueous medium through the liquid-feeding inlet 7. The particles of the polymerizable monomer composition and aqueous medium held in the polymerization vessel 12 are stirred with the stirring blade 5 driven by the stirring-blade drive unit 1, which are then maintained at a desired temperature for a certain time, whereupon the polymerizable monomers in particles of the polymerizable monomer composition are polymerized, thus the toner particles are formed.

Thereafter, a three-way valve 16 is opened toward a steam blow pipe 15 to remove any drain, scales and sludge having accumulated in a steam pipe 17, and thereafter the three-way valve 16 is opened toward the steam feed pipe 3 to introduce the saturated steam with a temperature higher than 100° C. Then, the steam feed valve 8 is opened to introduce the saturated steam with a temperature higher than 100° C. from the steam feed pipe 3 into the polymerization vessel 12. At this stage, the polymerization vessel 12 may be heated by the jacket 4, but may preferably be not heated in order to keep any deposits from adhering to the wall surface of the polymerization vessel 12. On continuing to introduce the saturated steam with a temperature higher than 100° C., the aqueous medium in the polymerization vessel reaches its boiling point, and the vapor thus formed is condensed by a condenser 13 through the bent pipe 14. The condensate thus obtained collects in a fraction tank (not shown). After it has collected in a stated quantity of fraction, the steam feed valve 8 is closed and the feeding of the saturated steam is stopped.

As a result of extensive studies made by the present inventors, it has been found that, by introducing the saturated steam with a temperature higher than 100° C. into the contents in the polymerization vessel 12 which are comprised of the toner particles and the aqueous medium, the temperature of the aqueous medium in the polymerization vessel can be maintained at the boiling point in virtue of the enthalpy of the saturated steam, and also the vapor of organic volatile components including at least the vapor of polymerizable monomers can be removed outside the polymerization vessel 12 system in a good efficiency by the carrier gas effect of the saturated steam.

If the saturated steam introduced has a temperature not higher than 100° C., the temperature of the aqueous medium in the polymerization vessel 12 does not reach the boiling point under normal pressure, so that the vapor of organic volatile components including polymerizable monomers may be removed outside the polymerization vessel 12 system at a low speed, undesirably. On the other hand, the introduction of the saturated steam with a temperature higher than 100° C. enables the aqueous medium in the aqueous-medium-containing polymerization vessel 12 to be maintained at the boiling point to afford a constant-temperature bath and make its temperature control very easy, desirably. The saturated steam may preferably have a temperature of from 105° C. to 180° C. in view of efficiency.

As also found by the present inventors, the condensate corresponding to the latent-heat content used to maintain the temperature in the polymerization vessel 12, in the enthalpy of the saturated steam, stays inside the polymerization vessel 12, so that the liquid surface of the contents in the polymerization vessel 12 rises and hence the quantity of deposits at the gas-liquid boundary of the contents in the polymerization vessel 12 can be made smaller.

In conventional distillation methods, the contents in the polymerization vessel 12 decreases, so that the liquid surface lowers and hence deposits may more form on the wall surface. In such a case, the deposits on the wall surface may become tougher upon heating when the polymerization vessel is kept heated by heat exchange. Such tough deposits may obstruct any stable drive of the system or intermingle with toner particles as impurities unless they are removed by periodic maintenance operation. Then, such periodic maintenance operation is undesirable because it lowers the production efficiency of toner particles to lead to an increase in production cost.

On the other hand, in the case when the saturated steam is introduced, the condensate corresponding to the latent-heat content makes larger the liquid content of the contents in the polymerization vessel 12 to make such contents less deposit on the wall surface. If, however, the saturated steam is introduced in excess, there is a possibility that the contents overflow the vessel 12. Accordingly, the quantity of the steam introduced may preferably be controlled in conformity with the volume of the vessel 12, and in accordance with operation time so that the contents may not overflow. The introduction of the saturated steam is also preferable because any deposits having formed in the polymerization vessel 12 during polymerization may swell because of the mist effect of the saturated steam to lessen the deposits.

The toner particles may also be covered on their surfaces with a sparingly soluble inorganic dispersant and may stand dispersed uniformly in the aqueous medium. In such a case, the toner particles are by no means adversely affected on their quality even when the saturated steam with a temperature higher than 100° C. is fed and the distillation is operated at normal pressure. Thus, the organic volatile components can be removed from toner particles in a good efficiency without causing any agglomeration of the toner particles, so that toner particles superior in quality can be produced.

The stirrer 11 to be installed in the granulation vessel 10 in the present invention may include batch type stirrers such as Ultra-Turrax (manufactured by IKA K.K.), Polytron (manufactured by Kinematica K.K.), TK Autohomomixer (manufactured by Tokushu Kika Kogyo K.K.) and National Cooking Mixer (manufactured by Matsushita Electric Works Ltd.); continuous stirrers such as Ebara Milder (manufactured by Ebara Corporation), TK Pipeline Homomixer and TK Homomix Lineflow (manufactured by Tokushu Kika Kogyo K.K.), Colloid Mill (manufactured by Nippon Seiki K.K.), Slasher (manufactured by Mitsui Miike Engineering Corporation), Trigonal Wet-type Fine Grinder (manufactured by Mitsui Miike Engineering Corporation), Cavitron (manufactured by Taiheiyo Kiko K.K.) and Fine Flow Mill (manufactured by Taiheiyo Kiko K.K.); batch or continuous bistirrers such as Clear Mix (manufactured by Emu Technique K.K.) and Filmics (manufactured by Tokushu Kika Kogyo K.K.); high-pressure emulsifiers such as Microfluidizer (manufactured by Mizuho Kogyo K.K.), Nanomaker and Nanomizer (manufactured by Hosokawa Micron K.K.) and APV Gorlin (manufactured by Gorlin Co.); and ultrasonic emulsifiers such as Ultrasonic Homogenizer (manufactured by Branson Co.).

The particle diameter of the toner particles obtained may usually be controlled by adjusting the quantity of a dispersion stabilizer used and the number of revolutions of the stirring blade. The peripheral speed of the stirring blade may be so controlled as to be a peripheral speed of from 15 to 40 m/sec. at the tips of the stirring blade. This is preferable in view of the sharpness of particle size distribution of the toner particles obtained. If its peripheral speed is less than 15 m/sec., it is difficult to make droplets small in a short time. If on the other hand the peripheral speed is more than 40 m/sec., very fine particles unsuited for their use as toner particles may be formed in a large number to tend to make particle size distribution broad. The stirring blade may more preferably be controlled to a peripheral speed of from 20 to 35 m/sec. as peripheral speed at its edge.

As stirrers to be installed in the dissolving vessel 9 and polymerization vessel 12, units are preferable which can uniformly stir the contents over the whole interiors of the vessels. Such stirrers may include, e.g., Paddle blade, Three-piece Backward blade, Anchor blade, and more preferably Fullzone blade (all manufactured by Shinko Panteck K.K.), Maxblend blade (manufactured by Sumitomo Heavy Industries, Ltd.), Sanmeler blade (manufactured by Mitsubishi Heavy Industries, Ltd.), Hi-F Mixer blade (manufactured by Soken Chemical & Engineering Co., Ltd.), Bendleaf blade (manufactured by Hakko Sangyo K.K.), and Dissolver blade (manufactured by Emu Technique K.K.). In FIGS. 1 to 4 and 6, the Fullzone blade is illustrated.

The saturated steam introduced into the polymerization vessel may preferably be at a pressure P (kPa) of:

$$126.6 \leqq P \leqq 1{,}013.3.$$

If it is at a pressure of less than 126.6 kPa, the heat efficiency may be so low that it takes a time to distill off the organic volatile components, undesirably. If on the other hand it is at a pressure of more than 1,013.3 kPa, any saturated steam can not be obtained by means of a usual steam generator to provide the factor of a high cost, undesirably.

Quantity A of contents distilled off from the polymerization vessel (distilled-off quantity A) and quantity B of contents in the polymerization vessel at the latter half of polymerization or after the polymerization has been completed may preferably be:

$$0.2 < A/B < 2;$$

and more preferably be:

$$0.5 < A/B < 1.5.$$

A value A/B of 0.2 or less is undesirable because the total amount of the organic volatile components including monomers having remained in the toner particles can be cut down to the stated amount with difficulty. Also, a value A/B of 2 or more is also undesirable because the steam is required in a large quantity in order to obtain the distilled-off quantity corresponding to the equivalent, great energy is required, the condensate may remain in the polymerization vessel in a large quantity and a polymerization vessel having a large volume must be used.

The saturated steam to be introduced also often contains a boiler compound such as sodium citrate as a protectant of a saturated-steam generator. In order to prevent this boiler compound from being mixed in products and also prevent any contaminants from being included in the feed water to be fed into the saturated-steam generator, the saturated steam may preferably be pure steam.

As to the feed pipe 3 through which the saturated steam is introduced, it may preferably be so set as to come inside the contents of the polymerization vessel as shown in FIG. 3, in order to prevent deposits from forming thereon. This is preferable also in order to assist the stirring of the contents.

The feed pipe 3 through which the saturated steam is introduced may also preferably be provided in the number of two or more in order to supply heat uniformly to the interior of the polymerization vessel and to make constant the temperature distribution of the contents of the polymerization vessel.

The stirring blade of the stirrer installed in the polymerization vessel may also preferably have a peripheral speed C (m/s) of:

$$0.5 < C < 5.$$

A value C of less than 0.5 is undesirable because the stirring is so weak as to tend to make the contents of the polymerization vessel have non-uniform temperature distribution and there is a possibility of bumping. A value C of more than 5 is also undesirable because the stirring tend to be performed in excess and the contents may overflow the polymerization vessel, or power consumption may increase to bring about an increase in production cost.

An angle $\alpha$ shown in FIG. 4 may preferably be:

$5° \leqq \alpha \leqq 80°$, and preferably $10° \leqq \alpha \leqq 60°$, in order to assist the stirring of the contents of the polymerization vessel.

An angle $\beta$shown in FIG. 3 may also preferably be:

$5° \leqq \beta \leqq 90°$, and preferably $45° \leqq \beta \leqq 90°$, in order to assist the stirring of the contents of the polymerization vessel and also utilize the enthalpy of the saturated steam. An angle $\beta$ of more than 90$\beta$ is undesirable because the efficiency of utilizing the enthalpy of the saturated steam tends to lower and the steam tends to spout from the liquid surface to tend to increase deposits on the wall surface.

According to the process for producing toner particles of the present invention, toner particles in which the total amount of organic volatile components at 150° C. is 500 ppm or less, preferably 400 ppm or less, and more preferably 300 ppm or less, can be produced in a good efficiency. In a toner prepared by adding an external additive to the toner particles whose organic volatile components at 150° C. is in a content of 500 ppm or less, the total amount of organic volatile components at 150° C. is 500 ppm or less. In a toner prepared by adding an external additive to the toner particles whose organic volatile components at 150° C. is in a content of 400 ppm or less, the total amount of organic volatile components at 150° C. is 400 ppm or less. In a toner prepared by adding an external additive to the toner particles whose organic volatile components at 150° C. is in a content of 300 ppm or less, the total amount of organic volatile components at 150° C. is 300 ppm or less.

In addition, according to the process for producing toner particles of the present invention, toner particles in which vinyl monomers are in a residue of 75 ppm or less, and preferably 50 ppm or less, can be produced in a good efficiency. Thus, from these toner particles, a toner can be provided which has the vinyl monomers in a residue of 75 ppm or less, and preferably 50 ppm or less.

In addition, according to the process for producing toner particles of the present invention, toner particles having an average circularity of 0.950 or more, preferably 0.960 or more, and more preferably 0.970 or more, can be formed. Thus, from these toner particles, a toner can be provided which has an average circularity of 0.950 or more, preferably 0.960 or more, and more preferably 0.970 or more. Incidentally, toner particles formed by melt kneading and pulverization commonly have an average circularity of 0.930 or less.

The toner of the present invention, which is characterized in that the binder resin contains as a chief component a vinyl resin selected from the group consisting of a styrene polymer, a polymer of a styrene derivative, a styrene-acrylate copolymer, a styrene-methacrylate copolymer, a styrene-acrylate-methacrylate copolymer and a mixture of any of these, that the total amount of organic volatile components contained in the toner, in terms of toluene based on the weight of the toner is 500 ppm or less and the residue of vinyl monomers contained in the toner, in terms of toluene based on the weight of the toner is 75 ppm or less, according to the analysis of the organic volatile components by the head space method at a heating temperature of 150° C. and that the toner has an average circularity of 0.950 or more, is a toner which does not give off any unpleasant smell at the time of heat-and-pressure fixing, can keep the photosensitive member surface from deteriorating, promises stable triboelectric charge characteristics in every environment, has also superior latent-image resolving power and can provide high-quality fixed images having a high image density and having no or less fog in non-image areas.

The method in which the toner particles are treated at a higher temperature than in conventional cases to carry out distillation to remove the organic volatile components including polymerizable monomers having remained in toner particles may also be applied to toner particles having core/shell structure.

As the chief component of the core, a low-softening substance is preferable, and may preferably be a compound showing a maximum endothermic peak temperature of from 40° C. to 120° C., and preferably from 40° C. to 90° C. as measured according to ASTM D3418-8. If the maximum endothermic peak temperature is lower than 40° C., the low-softening substance may have a weak self-cohesive force, undesirably resulting in weak high-temperature anti-offset properties at the time of the heat-and-pressure fixing of toner images. If on the other hand the maximum endothermic peak temperature is higher than 120° C., a high fixing temperature of the toner may result, undesirably. Moreover, if the endothermic peak temperature is at such a high temperature, the low-softening substance tends to precipitate during the granulation, undesirably.

In the present invention, the maximum endothermic peak temperature is measured using, e.g., a differential scanning calorimeter DSC-7, manufactured by Perkin-Elmer Corporation. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of heating of 10° C./min.

As the low-softening substance, it may preferably be a release agent. As the release agent, wax of various types may be used. The wax may include aliphatic hydrocarbon waxes such as low-molecular weight polyethylene, polyolefin copolymers, polyolefin wax, microcrystalline wax, paraffin wax and Fischer-Tropsh wax; oxides of aliphatic hydrocarbon waxes, such as polyethylene oxide wax; or block copolymers of these; vegetable waxes such as candelilla wax, carnauba wax, japan wax (haze wax) and jojoba wax; animal waxes such as bees wax, lanolin and spermaceti; mineral waxes such as ozokelite, serecin and petrolatum; waxes composed chiefly of a fatty ester, such as montanate wax and caster wax; and those obtained by subjecting part or the whole of a fatty ester to deoxydation, such as deoxidized carnauba was.

It may further include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also long-chain alkyl alcohols having a long-chain alkyl group; polyhydric alcohols such as sorbitol; fatty acid amides such as linolic acid amide, oleic acid amide and lauric acid amide; saturated fatty bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty acid metal salts (those commonly called metal soap) such as calcium stearate, calcium laurate, zinc stearate and magnesium stearate; partially esterified products of polyhydric alcohols with fatty acids, such as monoglyceride behenate; and methyl esterified products having a hydroxyl group, obtained by hydrogenation of vegetable fats and oils.

As a wax grafted with a vinyl monomer, it may include waxes obtained by grafting aliphatic hydrocarbon waxes with a vinyl monomer such as styrene or acrylic acid.

Waxes preferably used may include polyolefins obtained by radical-polymerizing olefins under high pressure; polyolefins obtained by purifying low-molecular-weight by-products formed at the time of the polymerization of high-molecular-weight polyolefins; polyolefins obtained by polymerization under low pressure in the presence of a catalyst such as a Ziegler catalyst or a metallocene catalyst; polyolefins obtained by polymerization utilizing radiations, electromagnetic waves or light; paraffin wax, microcrystalline wax, and Fischer-Tropsh wax; synthetic hydrocarbon waxes obtained by the Synthol process, the Hydrocol process or the Arge process; synthetic waxes comprised, as a monomer, of a compound having one carbon atom; hydrocarbon waxes having a functional group such as a hydroxyl group, a carboxyl group or an ester group; mixtures of hydrocarbon waxes and hydrocarbon waxes having a functional group; and modified waxes obtained by grafting to any of these waxes serving as a matrix, vinyl monomers such as styrene, maleate, acrylate, methacrylate or maleic anhydride.

Any of these waxes made to have sharp molecular-weight distribution by press sweating, solvent fractionation, recrystallization, vacuum distillation, ultracritical gas extraction or molten-liquid crystallization, as well as low-molecular-weight solid fatty acids, low-molecular-weight solid alcohols, low-molecular-weight solid compounds, and other waxes from which impurities have been removed may also preferably be used.

The wax which is one of the low-softening substance may preferably be incorporated in the toner particles in an amount of from 5 to 30% by weight. Its incorporation in an amount of less than 5% by weight may make it difficult to achieve good fixing performance and anti-offset properties of the toner. On the other hand, its incorporation in an amount of more than 30% by weight tends to cause toner particles to coalesce one another during granulation even when the toner particles are produced by polymerization, tending to produce toner particles having a broad particle size distribution.

As a specific method by which the low-softening substance is encapsulated in the toner particles, a low-softening substance whose polarity in an aqueous medium has been set smaller than the main polymerizable monomer may be used and also a small amount of resin or polymerizable monomer with a greater polarity than the main monomer may be added. Thus, toner particles having the core/shell structure can be obtained. The particle size distribution and average particle diameter of the toner particles may be controlled by a method in which the types and amounts of a water-insoluble inorganic salt and a dispersant having the action of protective colloids are changed, or by changing the conditions for agitation in a mechanical agitator (e.g., the peripheral speed of a rotor, pass times, and the shape of agitating blades), the shape of the reaction vessel, or the concentration of solid matter in the aqueous medium, whereby toner particles having a stated average particle diameter in a stated particle size distribution can be obtained.

As a specific method of observing cross sections of the toner particles, the toner or toner particles is/are well dispersed in a room temperature curing epoxy resin, followed by curing in an environment of temperature 40° C. for 2 days, and the cured product obtained is dyed with triruthenium tetraoxide optionally in combination with triosmium tetraoxide, thereafter samples are cut out in slices by means of a microtome having a diamond cutter, to observe the form of cross sections of toner particles using a transmission electron microscope (TEM). It is preferable to use the triruthenium tetraoxide dyeing method in order to form a contrast between the materials by utilizing some difference in crystallinity between the low-softening substance used and the resin constituting the shell.

As the polymerizable monomer used in the present invention, usable are styrene; styrene type monomers such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic or methacrylic acid amide. Any of these may be used alone or in the form of a mixture.

Any of these may usually be used in the form of an appropriate mixture of monomers so mixed that the theoretical glass transition temperature (Tg) as described in a publication POLYMER HANDBOOK, 2nd Edition III, pp. 139–192 (John Wiley & Sons, Inc.) ranges from 40° C. to 80° C. If the theoretical glass transition temperature is lower than 40° C., storage stability or running performance of the toner tends to lower. If on the other hand it is higher than 80° C., the fixing temperature of the toner may come higher. Especially in the case of color toners used to form full-color images, the color mixing performance of the respective color toners may lower, and also OHP images tend to have a low transparency.

Molecular weight of the shell (shell resin) of the toner particles having the core-shell structure is measured by gel permeation chromatography (GPC). As a specific method for measurement by GPC, the toner or toner particles is/are beforehand extracted with a toluene solvent for 20 hours by means of a Soxhlet extractor, and thereafter the toluene is evaporated by means of a rotary evaporator, followed by addition of an organic solvent capable of dissolving the low-softening substance but dissolving no shell resin (e.g., chloroform), to thoroughly carry out washing. Thereafter, the solution is dissolved in tetrahydrofuran (THF), and then filtered with a solvent-resistant membrane filter of 0.3 $\mu$m in pore diameter to obtain a sample. Molecular weight of the sample is measured using a detector 150C, manufactured by Waters Co. As column constitution, A-801, A-802, A-803, A-804, A-805, A-806 and A-807, available from Showa Denko K.K., are connected, and molecular weight distribution may be measured using a calibration curve of a standard polystyrene resin. The shell resin may preferably have a number-average molecular weight (Mn) of from 5,000 to 1,000,000, and a shell resin standing 2 to 100, and preferably from 4 to 100, as the ratio of weight average molecular weight (Mw) to number average molecular weight (Mn), Mw/Mn, is preferred.

In the present invention, when the toner particles having such core/shell structure are produced, in order to encapsulate the low-softening substance with the shell resin, it is particularly preferable to further add a polar resin as an additional shell resin. As the polar resin used in the present invention, copolymers of styrene with acrylic or methacrylic acid, maleic acid copolymers, saturated polyester resins and epoxy resins are preferably used. The polar resin may particularly preferably be those not containing in the molecule any unsaturated groups that may react with the shell resin and the polymerizable monomer. If a polar resin having such reactive unsaturated groups is contained, cross-linking reaction with the monomer that forms the shell resin layer takes place, so that a high-molecular-weight component and/or a THF-insoluble matter may be formed to make the shell resin have a too high molecular weight for toners for forming full-color images. Thus, such a resin is not preferable for toners for forming full-color images.

In the present invention, the surfaces of the toner particles may further be provided with an outermost shell resin layer. Such an outermost shell resin layer may preferably have a glass transition temperature so designed as to be higher than the glass transition temperature of the shell resin in order to more improve anti-blocking properties. The outermost shell resin layer may also preferably be cross-linked to such an extent that the fixing performance is not damaged. The outermost shell resin layer may preferably be incorporated with a polar resin or a charge control agent in order to improve charging performance.

There are no particular limitations on how to provide the outermost shell resin layer. For example, it may be provided by a method including the following.

(1) A method in which, at the latter half of polymerization reaction or after the reaction has been completed, a monomer in which a polar resin, a charge control agent and a cross-linking agent as occasion calls have been dissolved or dispersed is added to an aqueous medium in which toner particles are present, and is adsorbed on toner particles, followed by addition of a polymerization initiator to carry out polymerization.

(2) A method in which emulsion polymerization particles or soap-free polymerization particles formed of a monomer incorporated with a polar resin, a charge control agent and a cross-linking agent as occasion calls are added to an aqueous medium in which toner particles are present, and are caused to cohere to the surfaces of toner particles, optionally followed by heating to fix them.

(3) A method in which emulsion polymerization particles or soap-free polymerization particles formed of a monomer incorporated with a polar resin, a charge control agent, a cross-linking agent and so forth as occasion calls are mechanically caused to fix to the surfaces of toner particles by a dry process.

As to the colorant used in the present invention, carbon black or a magnetic material is used as a black colorant.

Where the magnetic materials is used as the black colorant, magnetic materials as shown below may be used. In this case, the magnetic material to be incorporated in magnetic toner particles may include iron oxides such as magnetite, maghematite and ferrite, and iron oxides including other metal oxides; metals such as Fe, Co and Ni, or alloys of any of these metals with any of metals such as Al, Co, Cu, Pb, Mg, Ni, Sn, Zn, Sb, Be, Bi, Cd, Ca, Mn, Se, Ti, W and V, and mixtures of any of these.

The magnetic material may specifically include triiron tetraoxide ($Fe_3O_4$), iron sesquioxide ($\gamma$-$Fe_2O_3$), zinc iron oxide ($ZnFe_2O_4$), yttrium iron oxide ($Y3Fe_5O_{12}$), cadmium iron oxide ($CdFe_2O_4$), gadolinium iron oxide ($Gd3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), lanthanum iron oxide ($LaFeO_3$), iron powder (Fe), cobalt powder (Co) and nickel powder (Ni). Any of the above magnetic materials may be used alone or in combination of two or more kinds.

As the particle shape of these magnetic materials, they may be octahedral, hexahedral, spherical, acicular or flaky. Those which are octahedral, hexahedral or spherical, having less anisotropy, are preferable in view of an improvement in image density.

In the case when the magnetic material is thus used as the black colorant, it is used in an amount, different from other colorants, of from 40 to 150 parts by weight based on 100 parts by weight of the polymerizable monomer or binder resin. It is preferable for the particle surfaces of the magnetic material to have been hydrophobic-treated.

When the particle surfaces of the magnetic material are made hydrophobic, a method of making surface treatment in an aqueous medium while dispersing the magnetic fine particles so as to have a primary particle diameter and hydrolyzing a coupling agent may be used. This is particularly preferable because the particle surfaces of the magnetic material are uniformly and appropriately hydrophobic-treated. This method of hydrophobic treatment in water or an aqueous medium may less cause the mutual coalescence of magnetic fine particles than any dry-process treatment made in a gaseous phase. Also, charge repulsion acts between magnetic material particles themselves as a result of hydrophobic treatment, so that the magnetic material particles are surface-treated substantially in the state of primary particles.

The method of surface-treating the magnetic material particles while hydrolyzing the coupling agent in an aqueous medium does not require any use of coupling agents which may generating gas, such as chlorosilanes and silazanes, and also enables use of highly viscous coupling agents which tend to cause mutual coalescence of magnetic material particles in a gaseous phase and hence have ever made it difficult to make good treatment. Thus, a great effect of making hydrophobic is obtainable.

In the case when the magnetic material particles are used as the colorant, the coupling agent usable in the surface treatment may include, e.g., silane coupling agents and titanium coupling agents. Preferably used are silane coupling agents, which are those represented by Formula (I).

$$R_mSiY_n \quad (I)$$

wherein R represents an alkoxyl group; m represents an integer of 1 to 3; Y represents a hydrocarbon group such as an alkyl group, a vinyl group, a glycidoxyl group or a methacrylic group; and n represents an integer of 1 to 3.

These may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

Of these, for improving the dispersibility of the magnetic material, it is preferable to use silane coupling agents having a double bond. More preferred are phenyltrimethoxysilane, γ-methacryloxypropyltrimethoxysilane and γ-glycidoxypropyltrimethoxysilane. This is because particularly in a case of suspension polymerization the treatment with the silane coupling agent having a double bond improves the fitting of the magnetic material to the polymerizable monomer. Thus, the dispersibility of the magnetic material in the toner particles is improved.

Besides the foregoing, yellow, magenta and cyan colorants shown below may also be used.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191 are preferably used.

As a magenta colorant, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are preferred.

As a cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62, 66 are preferably used.

In the case of color toners, the colorants are selected taking account of hue angle, chroma, brightness, weatherability, OHP transparency and dispersibility in toner particles. The colorant may preferably be added and used in an amount of from 1 to 20 parts by weight based on 100 parts by weight of the polymerizable monomer or binder resin.

As a charge control agent which may be used in the present invention, known agents may be used. In the case of color toners, it is particularly preferable to use charge control agents that are colorless, make toner charging speed higher and are capable of stably maintaining a constant charge quantity. Also, charge control agents having neither polymerization inhibitory action nor solubilisates in the aqueous system are particularly preferred. As negative charge control agents, they may include metal compounds of salicylic acid, dialkylsalicylic acid, naphthoic acid or dicarboxylic acids; polymer type compounds having sulfonic acid and/or carboxylic acid in the side chain; and boron compounds, urea compounds, silicon compounds and carixarene. As positive charge control agents, they may include quaternary ammonium salts, polymer type compounds having such a quaternary ammonium salt in the side chain, guanidine compounds, and imidazole compounds.

The charge control agent may preferably be used in an amount of from 0.5 to 10 parts by weight based on 100 parts by weight of the binder resin. In the present invention, however, the addition of the charge control agent is not essential. In the case of a two-component developing system, the triboelectric charging of the toner with a carrier may be utilized. In the case of a non-magnetic one-component developing system, the triboelectric charging of the toner with a blade coating blade member or sleeve member may be utilized. In either case, the charge control agent need not necessarily be contained in the toner particles.

Polymerization initiators usable in the present invention may include, e.g., azo- or diazo-type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide-type polymerization initiators such as benzoyl peroxide, methyl ethyl ketone peroxide, diisopropylperoxy carbonate, cumene hydroperoxide, 2,4-dichlorobenzoyl peroxide, lauroyl peroxide and t-butyl peroxydiethylhexanoate. The polymerization initiator may commonly be added in an amount of from 0.5 to 20% by weight, and preferably from 0.5 to 5% by weight, based on the weight of the polymerizable monomer, which may vary depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added.

As the cross-linking agent, it may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylehe glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxyethylene(2)-2,2-bis(4-hydroxyphenyl)propane diacrylate, polyoxyethylene(4)-2,2-bis(4-hydroxyphenyl)propane diacrylate, and the above compounds whose acrylate moiety has been replaced with methacrylate; and also polyester type diacrylate compounds as exemplified by MANDA (trade name; available from Nippon Kayaku Co., Ltd.).

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

When suspension polymerization is used as the process for producing the toner particles, a dispersion stabilizer to be used may include inorganic dispersion stabilizers such as tricalcium phosphate, hydroxyapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic dispersion stabilizers, it may include polyvinyl alcohol, gelatin, methyl cellulose, methyl hydroxypropyl cellulose, ethyl cellulose, carboxymethyl cellulose sodium salt, and starch. In the process for producing the toner particles of the present invention, in the step of removing the organic volatile components, the inorganic dispersion stabilizer is preferred in order to prevent the toner particles from agglomerating. Any of these dispersion stabilizers may preferably be used in an amount of from 0.2 to 10.0 parts by weight based on 100 parts by weight of the polymerizable monomer.

The water or the aqueous medium may be used in an amount of from 300 to 3,000 parts by weight based on 100 parts by weight of the polymerizable monomer.

As these dispersion stabilizers, those commercially available may be used as they are. In order to obtain dispersion stabilizers having fine and uniform particle size, however, it is also a preferable method that the inorganic dispersion stabilizer is formed in the dispersion medium such as the water or the aqueous medium under high-speed agitation. For example, in the case of tricalcium phosphate or hydroxyapatite, an aqueous sodium phosphate solution and an aqueous calcium chloride solution may be mixed under high-speed agitation, whereby a dispersion stabilizer preferable for the suspension polymerization can be obtained. Also, in order to make these dispersion stabilizers fine, 0.001 to 0.1 parts by weight of a surface-active agent may be used in combination. As the surface-active agent, commercially available nonion, anion and cation type surface-active agents may be used. For example, the surface-active agent may include sodium dodecyl sulfate, sodium tetradecyl sulfate, sodium pentadecyl sulfate, sodium octyl sulfate, sodium oleate, sodium laurate, potassium stearate and calcium oleate.

As a process for producing the toner particles of the present invention, for example, when carried out by suspension polymerization, a polymerizable monomer composition is prepared in the dissolving vessel 9 shown in FIG. 5, by adding to the polymerizable monomer the low-softening substance release agent, the colorant, the charge control agent, the polymerization initiator and other additives and uniformly dissolving or dispersing them. This composition is then stirred and dispersed to carry out granulation by means of the stirrer 11 in the granulation vessel 10 holding therein the aqueous medium containing the dispersion stabilizer. Where at this point there are additives which are difficult to disperse in the dissolving vessel 9, such additives may previously be dispersed or dissolved in a different vessel and then may be introduced into the dissolving vessel 9. At the stage where the particles of the polymerizable monomer composition which correspond to the size of desired toner particles comprised of the polymerizable monomer composition have been obtained in the granulation vessel 10, the stirring in the granulation vessel 10 is stopped. Thereafter, the state of the particles of the polymerizable monomer composition is maintained by the action of the dispersion stabilizer. Accordingly, a liquid product having the aqueous medium and the particles of the polymerizable monomer composition is sent to the polymerization vessel 12, where its contents may be stirred to such an extent that the particles of the polymerizable monomer composition can be prevented from settling. The polymerizable monomer composition may be polymerized at a polymerization temperature set at 40° C. or above, usually from 50° C. to 90° C. Also, at the latter half of the polymerization, the temperature may be raised.

Then, at the latter half of polymerization or after the polymerization has been completed, the saturated steam with a temperature higher than 100° C. is introduced into the aqueous medium in the polymerization vessel through the steam feed pipe in order to remove the organic volatile components such as unreacted polymerizable monomers and low-molecular-weight volatile by-products from the toner particles. The saturated steam may preferably be so introduced that the quantity of the contents held in the polymerization vessel 12 after the saturated steam has been introduced may come larger than the quantity of the contents held therein at the latter half of polymerization or after the polymerization has been completed. The organic volatile components are distilled off from the aqueous medium of the contents and from the toner particles through the bent pipe 14 together with water vapor. After they have been distilled off, the toner particles are washed, followed by filtration and then drying.

Any external additive of the toner particles may preferably have a particle diameter of not more than 1/10 of the weight average particle diameter of the toner particles, in view of its durability when added externally to the toner. The particle diameter of the external additive refers to the number average particle diameter obtained by observing the surfaces of toner particles on an electron microscope. As the external additive may include the following:

Metal oxides such as aluminum oxide, titanium oxide, cerium oxide, magnesium oxide, chromium oxide, tin oxide and zinc oxide; nitrides such as silicon nitride; carbides such as silicon carbide; metal salts such as strontium titanate, calcium sulfate, barium sulfate and calcium carbonate; fatty-acid metal salts such as zinc stearate and calcium stearate; carbon black; and silica. Any of these external additives may be used in an amount of from 0.01 to 10 parts by weight, and preferably from 0.05 to 5 parts by weight, based on 100 parts by weight of the toner particles, and may be used alone or may be used in combination in plurality. An external additive having been subjected to hydrophobic treatment with the silane coupling agent and/or silicone oil is more preferred.

The particle size distribution of the toner may be measured by various methods. In the present invention, it may preferably be measured with a Coulter counter.

As a measuring instrument, Coulter Counter Multisizer Model-I or -II or -IIe (manufactured by Coulter Electronics, Inc.) is used. An interface (manufactured by Nikkaki k.k.) that outputs number-average distribution and volume-average distribution and a commonly available personal computer are connected. As an electrolytic solution, an aqueous 1% NaCl solution is prepared using guaranteed or first-grade sodium chloride.

As a method of measurement, as a dispersant from 0.1 to 5 ml of a surface active agent (preferably an alkylbenzene sulfonate) is added to from 100 to 150 ml of the above aqueous electrolytic solution, and from 2 to 20 mg of a sample to be measured is further added. The electrolytic solution in which the sample has been suspended is subjected to dispersion for about 1 minute to about 3 minutes in an ultrasonic dispersion machine. The particle size distribution (number distribution) of particles of 2 $\mu$m to 40 $\mu$m in diameter is measured on the basis of the number of particles, by means of the above Coulter Multisizer Model-II, using an aperture of 100 $\mu$m as its aperture. Then the respective values are determined from the particle size distribution (number distribution).

The coefficient of variation in the above number distribution is calculated from the following expression.

Coefficient of variation=[S/D1]×100 wherein S represents the standard deviation in the number distribution of toner particles, and D1 represents number average particle diameter ($\mu$m) of the toner particles.

The total amount of the organic volatile components in the toner particles or toner of the present invention is quantitatively determined using the head space method. The head space method is a method in which the toner particles or toner is/are sealed in a hermetically sealed container and then heated at 150° C. for 60 minutes to make the sample and the gaseous-phase space stand equilibrium, and thereafter the gas of the gaseous-phase part in the hermetically sealed container is subjected to gas chromatography (GC) to determine the organic volatile components quantitatively. Here, an FID (flame ionization detector) is used as a detector of a gas chromatograph to detect the organic volatile components. Conventionally, as a method of analyzing volatile components remaining in toner particles or a toner, a method is known in which the toner is dissolved in a solvent and the solution formed is injected into a gas chromatograph to make quantitative determination. In such a method, however, the peaks of the volatile components may be imbedded in the solvent peak, and hence this method is undesirable as the method of determining organic volatile components of toners. Specific measuring instrument, conditions and method are shown below.

Measuring Instrument and Conditions

| | |
|---|---|
| Head space sampler: | HEWLETT PACKARD 7694. |
| Oven temperature: | 150° C. |
| Sample-heating time: | 60 minutes. |
| Sample loop (Ni): | 1 ml. |
| Loop temperature: | 170° C. |
| Transfer line temperature: | 190° C. |
| Pressure time: | 0.50 minute. |
| LOOP FILL time: | 0.01 minute. |
| LOOP EQ time: | 0.06 minute. |
| INJECT time: | 1.00 minute. |
| GC cycle time: | 80 minutes. |
| Carrier gas: | He. |
| GC: | HEWLETT PACKARD 6890GC (detector: FID). |
| Column: | HP-1 (inner diameter 0.25 $\mu$m × 30 m). |
| Carrier gas: | He. |
| Oven: | 35° C.; 20 minutes hold, heating to 300° C. at 20° C./minute, and 20 minutes hold. |
| INJ: | 300° C. |
| DET: | 320° C. |

Splitless, constant pressure (20 psi) mode.

Measurement

Toner particles or toner precisely weighed in an amount of 30 mg is/are put into a vial bottle (volume: 22 ml) for the head space, and then, by means of a crimper, the bottle is sealed with a crimp cap and a fluorine-resin-coated septum for exclusive use. This vial bottle is set in the head space sampler, and its contents are analyzed under the above-mentioned conditions. Each peak area value of the GC chart obtained is run through data processing and calculated as volatile components. The respective volatile components are added to measure the total amount of the organic volatile components of the toner particles or toner. Here, an empty vial bottle in which any toner particles or toner is/are not sealed is simultaneously measured as a blank. Then, in respect of, e.g., the blank value of organic volatile components and so forth which volatilize through the septum, the value is subtracted from the measured data of the toner particles or toner. As to the total amount of organic volatile components in terms of toluene based on the weight of the toner particles or toner, vial bottles into which only toluene is put in amounts precisely weighed at few points (e.g., 0.1 $\mu$l, 0.5 $\mu$l and 1.0 $\mu$l) are made ready and are each measured under the above analysis conditions before the measurement is made on toner particle samples or toner samples, and thereafter a calibration curve is prepared from the quantity of toluene put into the bottle and the areal value of toluene, where, on the basis of this calibration curve, the areal value of the organic volatile components of the toner particles or toner may be converted into the weight of toluene that is based on the weight of the toner particles or toner.

Moisture content of the toner particles or toner is measured with an electronic moisture content meter MA40 (manufactured by Sartorius Co.) by the 105° C. weight-loss-on-heating method.

Average Circularity

The circularity referred to in the present invention is used as a simple method for expressing the shape of toner quantitatively. In the present invention, the shape of particles is measured with a flow type particle image analyzer FPIA- 2100, manufactured by Sysmex Co., and the circularity of particles thus measured is calculated according to the following equation (1). As further shown in the following equation (2), the value obtained when the sum total of circularity of all particles measured is divided by the number of all particles is defined to be the average circularity.

$$\text{Circularity } a = L_0/L \quad (1)$$

wherein $L_0$ represents the circumferential length of a circle having the same projected area as a particle image, and L represents the circumferential length of the particle image obtained by image processing at an image-processing resolution of 512×512 (pixels of 0.3 μm×0.3 μm).

What is meant by "image-processing resolution of 512×512 (pixels of 0.3 μm×0.3 μm)" is that an image where 512 pixels of 0.3 μm square are arranged is used as a visual field of measurement.

$$\text{Average circularity } a = \sum_{i=1}^{m} ai/m \quad (2)$$

wherein ai is the circularity of each particle, and m is the number of measured particles.

The circularity referred to in the present invention is an index showing the degree of surface unevenness of particles. It is indicated as 1.000 when the particles are perfectly spherical. The more complicate the surface shape is, the smaller the value of circularity is.

The measuring instrument "FPIA-2100" used in the present invention employs a calculation method in which, in calculating the circularity of each particle and thereafter calculating the average circularity and circularity standard deviation, circularities of 0.4 to 1.0 are divided into 61 classes at intervals of 0.010, and the average circularity and circularity standard deviation are calculated using the center values and frequencies of divided points. Between the values of the average circularity and circularity standard deviation calculated by this calculation method and the values of the average circularity and circularity standard deviation calculated by the above calculation equation which uses the circularity of each particle directly, there is only a very small accidental error, which is at a level that is substantially negligible. Accordingly, in the present invention, such a calculation method in which the concept of the calculation equation which uses the circularity of each particle directly is utilized and is partly modified may be used, for the reasons of handling data, e.g., making the calculation time short and making the operational equation for calculation simple.

In addition, the measuring instrument "FPIA-2100" used in the present invention is, compared with "FPIA-1000" used conventionally to calculate the particle shape of toners, an instrument whose sheathed flow (the thickness of a cell at the part where a sample solution flows between a CCD camera and a strobe) has been made small (7 μm→4 μm) and which has been improved in precision of the measurement of toner particle shapes by improving the magnification of processed particle images and also improving the processing resolution of images taken in it (256×256→512×512), and thereby has achieved more reliable analysis of fine particles. Hence, when the particle shape must more accurately be measured as in the present invention, FPIA-2100 is more useful, which can more accurately obtain the information relating to the particle shape. FPIA-1000 becomes unable to trace the contours of particles as the particles have smaller particle diameter, where it has had a tendency that the particles are measured to have a higher value as the circularity, i.e., to be rounder particles.

As a specific method of measuring the circularity, 0.1 to 0.5 ml of a surface-active agent, preferably an alkylbenzene sulfonate, as a dispersant is added to 100 to 150 ml of water from which any impurities have previously been removed. To this solution, about 0.1 to 0.5 g of a measuring sample is further added. The resultant dispersion in which the sample has been dispersed is irradiated with ultrasonic waves (50 kHz, 120 W) for 1 to 3 minutes. Adjusting the dispersion concentration to 12,000 to 20,000 particles/μl and using the above flow type particle image analyzer, the circularity distribution of particles having circle-corresponding diameters of from 3.00 μm to less than 159.21 μm is measured.

The outline of measurement is as follows:

The sample dispersion is passed through channels (extending along the flow direction) of a flat flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circularity of each particle is calculated from the projected area of the two-dimensional image of each particle and the circumferential length of the projected image according to the above equation for calculating the circularity.

The present invention is described below in greater detail by giving Examples.

EXAMPLE 1

Into 710 g of ion-exchanged water held in the granulation vessel shown in FIG. 5, 450 parts by weight of an aqueous 0.1 mol/liter $Na_3PO_4$ solution was introduced and 14 parts by weight of 1 mol/liter hydrochloric acid was introduced, and the mixture formed was heated to 60° C., followed by stirring by means of a Clear Mix high-speed stirrer 11 (manufactured by Emu Tekunikku K.K.) set in the granulation container 10 shown in FIG. 5. Then, 68 parts by weight of an aqueous 1.0 mol/liter $CaCl_2$ solution was little by little added thereto to obtain an aqueous medium containing calcium phosphate $Ca_3(PO_4)_2$.

| | (by weight) |
|---|---|
| Monomers: | |
| Styrene | 160 parts |
| n-Butyl acrylate | 40 parts |
| Colorant: C.I. Pigment Blue 15:3 | 14 parts |
| Charge control agent: Dialkylsalicylic acid metal compound (E88, manufactured by Orient Chemical Industry Corporation) | 2 parts |
| Polar resin: Saturated polyester (Polyester made of terephthalic acid and propylene oxided modified bisphenol A) (acid value: 10 mg · KOH; peak molecular weight: 7,500) | 10 parts |
| Release agent: Ester wax (Behenic acid behenate) (maximum endothermic peak temperature in DSC: 72° C.) | 40 parts |

The above materials were heated to 60° C., and then stirred in the dissolving container 9 to dissolve or disperse the materials uniformly in the monomers. In the mixture obtained, 10 parts by weight of a polymerization initiator 2,2'-azobis(2,4-dimethylvaleronitrile) was dissolved. Thus, a polymerizable monomer composition was prepared.

The polymerizable monomer composition held in the dissolving container 9 was introduced into the aqueous medium held in the granulation container 10, followed by stirring at 60° C. in an atmosphere of $N_2$ for 10 minutes by means of the stirrer 11 in the granulation container 10 (blade tip peripheral speed: 22 m/s), to form particles of the polymerizable monomer composition in the aqueous medium. Thereafter, the stirrer 11 in the granulation container 10 was stopped, and then, through the liquid feed inlet 7, the contents of the granulation container 10 were introduced into the polymerization vessel 12 having a Full-zone stirring blade 5 (manufactured by Shinko Panteck K.K.). In the polymerization vessel 12, the polymerizable monomers were allowed to react at a temperature of 60° C. in an atmosphere of $N_2$ for 5 hours with stirring by means of the stirring blade 5 (stirring maximum peripheral speed: 3 m/s). Thereafter, the temperature was raised to 80° C., where the polymerizable monomers were further allowed to react for 5 hours.

After the polymerization reaction was completed, the heating from the jacket 4 was stopped, and then the steam feed valve 8 was opened to introduce, per 2,000 kg of the aqueous medium, pure saturated steam into the contents in the polymerization vessel 12 through the steam feed pipe 3 at a rate of 500 kg per hour (steam pressure: 205 kPa; temperature: 120° C.). After 30 minutes from the starting of introducing the saturated steam, the temperature of the contents of the polymerization container reached 100° C., and a fraction began to come out of the bent pipe 14 through the condenser 13. After 3 hours from the point of time the temperature in the polymerization vessel reached 100° C., the steam feed valve 8 was closed, and then cooling water was made to flow into the jacket 4 to cool the contents of the polymerization container 12. Here, the value of A/B was 0.6. Thereafter, hydrochloric acid was added to the aqueous medium to dissolve the calcium phosphate, followed by washing with water and filtration to obtain wet toner particles. After their production, how deposits had formed on the inner wall surface of the polymerization vessel and on the saturated-steam feed pipe was examined.

The particle size distribution, coefficient of number variation, moisture content, styrene and n-butyl acrylate residual monomers each in terms of toluene and total amount of organic volatile components of the wet toner particles were measured.

The results of the foregoing are shown in Tables 1 and 2.

The wet toner particles thus obtained were dried using an airborne dryer (manufactured by Seishin Kigyo K.K.; a flash jet dryer; pipe diameter: 0.1016 m) under the following conditions to obtain toner particles.

Drying Conditions

| | |
|---|---|
| Blowing temperature: | 90° C. |
| Blowing air flow: | 10 $m^3$/min. |
| Wet toner particles feed rate: | 50 kg/hr. |

The moisture content, styrene and n-butyl acrylate residual monomers and total amount of organic volatile components of the toner particles having been dried were measured to obtain the results shown in Table 2.

Cross sections of the toner particles were also observed to confirm their core/shell structure.

To 100 parts by weight of the toner particles thus obtained, 1.0 part by weight of hydrophobic fine silica powder having a specific surface area of 200 $m^2$/g as measured by the BET method (number-average particle diameter: about 10 nm) was externally added to obtain a toner. To 5 parts by weight of this toner, 95 parts by weight of a magnetic ferrite carrier coated with silicone resin was blended to prepare a two-component developer. Various physical properties of the toner are shown in Table 3.

Using this two-component developer and using a remodeled machine of a digital full-color copying machine CLC500, manufactured by CANON INC. (CLC500 was remodeled for monochromatic copying), digital latent images were reverse-developed to form toner images, and the toner images were heat-and-pressure fixed to plain paper to reproduce images continuously on 5,000 sheets to make evaluation. Smell was less given off during even such many-sheet running. Fog also less appeared, image density was stable, and resolution was excellent. Thus, good cyan images were obtained. The results are shown in Table 3.

Evaluation items shown in Examples of the present invention and Comparative Examples and judgement criteria for the evaluation are described below.

Image Density

To measure image density, solid images were formed, and the solid images was measured with Macbeth Reflection Densitometer (manufactured by Macbeth Co.). As evaluation criteria, the image density is evaluated as "good" when the value of Macbeth density is 1.2 or more; "image density of a little problem on images but of no problem in practical use" when it is 1.0 or more to less than 1.2; and "undesirable image density" when it is less than 1.0.

Fog

Fog was measured with REFLECTOMETER MODEL TC-6DS, manufactured by Tokyo Denshoku K.K. As its filter, a green filter was used. Fog was calculated according to the following expression.

Fog=reflectance (%) on reference paper−reflectance (%) at non-image area of sample.

Evaluation criteria of fog are as follows:

| | |
|---|---|
| A: | Very good (less than 1.5%). |
| B: | Good (1.5% or more to less than 2.5%). |
| C: | Average (2.5% or more to less than 4.0%). |
| D: | Poor (4.0% or more). |

Deposition on Inner Wall Surface of Polymerization Vessel

| | |
|---|---|
| A: | To an extent that deposits are removable by water washing of a shower level. |
| B: | To an extent that a film remains thinly on the surface upon water washing of a shower level. |
| C: | Deposits are too tough to be removed unless they are wiped off with a solvent. |

Deposition on Saturated Steam Feed Pipe

| | |
|---|---|
| A: | To an extent that deposits are removable by water washing of a shower level. |
| B: | To an extent that a film remains thinly on the surface upon water washing of a shower level. |
| C: | Deposits are too tough to be removed unless they are wiped off with a solvent. |

EXAMPLE 2

Wet toner particles, toner particles, a toner and a two-component developer were obtained in the same manner as in Example 1 except that, after the polymerization reaction was completed, the steam feed valve was opened to introduce the pure saturated steam into the aqueous medium in the polymerization vessel at a rate of 500 kg per hour (steam pressure: 500 kPa; temperature: 151° C.). Here, the value of A/B was 1.2. The results of measurement and evaluation on the respective items are shown in Tables 1 to 3.

EXAMPLE 3

Wet toner particles, toner particles, a toner and a two-component developer were obtained in the same manner as in Example 1 except that, after the polymerization reaction was completed, the steam feed valve was opened to introduce the pure saturated steam into the aqueous medium in the polymerization vessel at a rate of 500 kg per hour (steam pressure: 115 kPa; temperature: 103° C.). Here, the value of A/B was 0.4. The results of measurement and evaluation on the respective items are shown in Tables 1 to 3.

EXAMPLE 4

Wet toner particles, toner particles, a toner and a two-component developer were obtained in the same manner as in Example 1 except that, after the polymerization reaction was completed, the steam feed valve was opened to introduce the pure saturated steam into the aqueous medium in the polymerization vessel at a rate of 300 kg per hour (steam pressure: 205 kPa; temperature: 120° C.). Here, the value of A/B was 0.3. The results of measurement and evaluation on the respective items are shown in Tables 1 to 3.

EXAMPLE 5

Wet toner particles, toner particles, a toner and a two-component developer were obtained in the same manner as in Example 1 except that, after the polymerization reaction was completed, the steam feed valve was opened and then the steam feed valve was closed after 6 hours from the point of time the temperature in the polymerization vessel reached 100° C., to stop the feeding of pure saturated steam. Here, the value of A/B was 0.6. The results of measurement and evaluation on the respective items are shown in Tables 1 to 3.

EXAMPLE 6

Wet toner particles, toner particles, a toner and a two-component developer were obtained in the same manner as in Example 1 except that, after the polymerization reaction was completed, the steam feed valve was opened to introduce the pure saturated steam at a rate of 800 kg per hour (steam pressure: 205 kPa; temperature: 120° C.). Here, the value of A/B was 1.1. The results of measurement and evaluation on the respective items are shown in Tables 1 to 3.

EXAMPLE 7

Wet toner particles, toner particles, a toner and a two-component developer were obtained in the same manner as in Example 1 except that, after the polymerization reaction was completed, the steam feed valve was opened to introduce steam formed from water to which sodium citrate was added as a boiler compound. Here, the value of A/B was 0.6. The results of measurement and evaluation on the respective items are shown in Tables 1 to 3.

EXAMPLE 8

Wet toner particles, toner particles, a toner and a two-component developer were obtained in the same manner as in Example 1 except that the polymerization vessel shown in FIGS. 3 and 4 ($\alpha$=30°; $\beta$=20°) was used. Here, the value of A/B was 0.6. The results of measurement and evaluation on the respective items are shown in Tables 1 to 3.

EXAMPLE 9

Wet toner particles, toner particles, a toner and a two-component developer were obtained in the same manner as in Example 1 except that the polymerization vessel shown in FIG. 2 was used. Here, the value of A/B was 0.6. The results of measurement and evaluation on the respective items are shown in Tables 1 to 3.

EXAMPLE 10

Wet toner particles, toner particles, a toner and a two-component developer were obtained in the same manner as in Example 1 except that the stirring maximum peripheral speed in the polymerization vessel was changed to 1.5 m/sec. Here, the value of A/B was 0.55. The results of measurement and evaluation on the respective items are shown in Tables 1 to 3.

EXAMPLE 11

Wet toner particles, toner particles, a toner and a two-component developer were obtained in the same manner as in Example 1 except that the stirring maximum peripheral speed in the polymerization vessel was changed to 4.5 m/sec. Here, the value of A/B was 0.65. The results of measurement and evaluation on the respective items are shown in Tables 1 to 3.

EXAMPLE 12

Wet toner particles, toner particles, a toner and a two-component developer were obtained in the same manner as in Example 7 except that, after the polymerization reaction was completed, the stirring blade in the polymerization vessel was stopped and the stirring blade was detached. Even though the stirring blade was stopped, the contents of the polymerization container were seen to have uniformly been mixed by the action of propellant force of the saturated steam introduced. Here, the value of A/B was 0.55. The results of measurement and evaluation on the respective items are shown in Tables 1 to 3.

EXAMPLE 13

Wet toner particles, toner particles, a toner and a two-component developer were obtained in the same manner as in Example 12 except that the polymerization vessel was set to be $\alpha$=45° and $\beta$=45°. Here, the value of A/B was 0.6. The results of measurement and evaluation on the respective items are shown in Tables 1 to 3.

EXAMPLE 14

Wet toner particles, toner particles, a toner and a two-component developer were obtained in the same manner as in Example 12 except that the polymerization vessel was set to be $\alpha$=60° and $\beta$=60°. Here, the value of A/B was 0.52. The results of measurement and evaluation on the respective items are shown in Tables 1 to 3.

EXAMPLE 15

A surface-treated magnetic material was prepared in the following way.

In an aqueous ferrous sulfate solution, a sodium hydroxide solution in an amount of 1.0 to 1.1 equivalent weight on the basis of iron element, sodium hexametaphosphate in an amount of 0.95% by weight in terms of phosphorus element on the basis of iron element and sodium silicate in an amount of 0.95% by weight in terms of silicon element on the basis of iron element were mixed to prepare an aqueous solution containing ferrous hydroxide.

Maintaining the pH of the aqueous solution to about 13, air was blown to carry out oxidation reaction at 80 to 90° C. to obtain a slurry of magnetic particles. After the slurry was washed and then filtered, the resultant water-containing slurry was first taken out. Here, a water-containing sample was taken therefrom in a small quantity and its moisture content was beforehand measured. Then, this water-containing sample was again dispersed in another aqueous medium without drying, and thereafter the pH of the dispersion obtained was adjusted to about 6, to which, based on 100 parts by weight of the magnetic particles, 1.9 parts by weight of a coupling agent n-hexyltrimethoxysilane and 1.1 parts by weight of a coupling agent γ-methacryloxypropyltrimethoxysilane were added with sufficient stirring (the quantity of the magnetic particles was calculated as a value found by subtracting the moisture content from the water-containing sample) to carry out coupling treatment. Hydrophobic magnetic particles thus formed were washed, filtered and then dried. The hydrophobic magnetic particles thus obtained were subjected to sufficient disintegration treatment to obtain surface-treated magnetic particles having a number-average particle diameter of 0.13 μm and a coefficient of number-average variation of 8.

Into 720 g of ion-exchanged water, 450 parts by weight of an aqueous 0.1 mol/liter $Na_3PO_4$ solution and 16 parts by weight of 1 mol/liter hydrochloric acid were introduced, and the mixture formed was heated to 60° C., followed by stirring by means of a Clear Mix high-speed stirrer (manufactured by Emu Tekunikku K.K.) set in the granulation container 10 shown in FIG. 5. Then, 67.7 parts by weight of an aqueous 1.0 mol/liter CaCl2 solution was little by little added thereto to obtain an aqueous medium containing calcium phosphate $Ca_3(PO_4)_2$.

| | (by weight) |
|---|---|
| Styrene | 78 parts |
| n-Butyl acrylate | 22 parts |
| Saturated polyester resin (the same resin as used in Example 1) | 1 part |
| Divinylbenzene | 0.20 part |
| Ester wax (the same wax as used in Example 1) (maximum endothermic peak temperature in DSC: 72° C.) | 7 parts |
| Negative charge control agent (Fe compound of a monoazo dye, T77, manufactured by Hodogaya Kagaku K. K.) | 1 part |
| Above surface-treated magnetic particles | 85 parts |

The above materials were heated to 60° C., and then stirred in the dissolving container 9 shown in FIG. 5, to dissolve or disperse the materials uniformly. In the mixture obtained, 4 parts by weight of a polymerization initiator benzoyl peroxide was dissolved. Thus, a polymerizable monomer composition was prepared.

The polymerizable monomer composition was introduced into the aqueous medium, followed by stirring at 60° C. in an atmosphere of $N_2$ for 15 minutes by means of the stirrer 11 in the granulation container 10 (blade tip peripheral speed: 22 m/s), to form particles of the polymerizable monomer composition by granulation. Thereafter, the stirrer in the granulation container was stopped, and then the contents were forwarded to the polymerization vessel 12 having a Full-zone stirring blade (manufactured by Shinko Panteck K.K.). In the polymerization vessel 12, the polymerizable monomers were allowed to react at a temperature of 60° C., which was gradually raised to 80° C., and thereafter further react for 4 hours in an atmosphere of $N_2$ with stirring by means of the stirring blade (stirring maximum peripheral speed: 3 m/s).

After the polymerization reaction was completed, the heating from the jacket 4 was stopped, and then the steam feed valve 8 was opened to introduce pure saturated steam into the polymerization vessel at a rate of 500 kg per hour (steam pressure: 205 kPa; temperature: 120° C.). After 30 minutes, the temperature of the contents of the polymerization container 12 reached 100° C., and a fraction began to come out of the bent pipe 14 through the condenser 13. After 3 hours from the point of time the temperature in the polymerization vessel reached 100° C., the steam feed valve 8 was closed, and then cooling water was made to flow into the jacket 4 to cool the contents of the polymerization container 12. Here, the value of A/B was 0.6. Thereafter, hydrochloric acid was added to the aqueous medium to dissolve the calcium phosphate, followed by washing with water, filtration and disintegration to obtain wet toner particles. Here, the value of A/B was 0.6. After their production, how deposits had formed on the inner wall surface of the polymerization vessel and on the saturated-steam feed pipe was examined.

The particle size distribution, coefficient of number variation, moisture content, styrene and n-butyl acrylate residual monomers each in terms of toluene and total amount of organic volatile components of the wet toner particles were measured.

The results of the foregoing are shown in Tables 1 and 2.

The wet toner particles thus obtained were dried using an airborne dryer (manufactured by Seishin Kigyo K.K.; a flash jet dryer; pipe diameter: 0.1016 m) under the same conditions as in Example 1 to obtain magnetic toner particles.

The moisture content after treatment, styrene and n-butyl acrylate residual monomers and total amount of organic volatile components of the magnetic toner particles having been dried were measured to obtain the results shown in Table 2.

Cross sections of the magnetic toner particles were also observed to confirm their core/shell structure.

100 parts by weight of the magnetic toner particles thus obtained and 1.0 part by weight of hydrophobic fine silica powder (number-average primary particle diameter: 12 nm) obtained by treating fine silica powder of 12 nm in number-average primary particle diameter (BET specific surface area: 180 $m^2/g$) with hexamethyldisilazane and thereafter with silicone oil and having a BET specific surface area of 120 $m^2/g$ after the treatment were mixed by means of a Henschel mixer (manufactured by Mitsui Miike Engineering Corporation) to obtain a magnetic toner. Various physical properties of the magnetic toner are shown in Table 3.

Using this magnetic toner and using as an image-forming apparatus a remodeled machine of a laser beam printer LBP-1760, manufactured by CANON INC., images were reproduced to make evaluation.

First, 100 g of the magnetic toner obtained was loaded into a developing assembly of a process cartridge of the printer. In a high-temperature and high-humidity environment (30° C., 80% RH), solid black images with an image density of 1.42 were formed so controlling that the toner quantity on paper came to 0.8 $mg/cm^2$. Thereafter, as a toner deterioration acceleration test, the printer was idled for 2 hours, and thereafter image reproduction was tested on 5,000 sheets in an image pattern consisting of only horizontal lines with a print percentage of 2%. As the result, after the image reproduction on 5,000 sheets, the magnetic toner obtained provided very good images free of any fog on non-image areas. The results of evaluation are shown in Table 3.

EXAMPLE 16

Wet toner particles, magnetic toner particles and a magnetic toner were obtained in the same manner as in Example 15 except that, after the polymerization reaction was completed, the steam feed valve 8 was opened to introduce the pure saturated steam into the aqueous medium in the polymerization vessel at a rate of 800 kg per hour (steam pressure: 205 kPa; temperature: 120° C.). Here, the value of A/B was 1.10. The results of measurement and evaluation on the respective items are shown in Tables 1 to 3.

EXAMPLE 17

Wet toner particles, toner particles and a developer were obtained in the same manner as in Example 15 except that, after the polymerization reaction was completed, the steam feed valve 8 was opened to introduce the pure saturated steam into the aqueous medium in the polymerization vessel at a rate of 300 kg per hour (steam pressure: 205 kPa; temperature: 120° C.). Here, the value of A/B was 0.30. The results of measurement and evaluation on the respective items are shown in Tables 1 to 3.

REFERENCE EXAMPLE 1

Particles of a polymerizable monomer composition which were obtained in the same manner as in Example 1 were put into a polymerization vessel 12A (FIG. 6), and polymerization reaction was carried out with stirring, at a temperature of 60° C. for 5 hours and further for 5 hours after the temperature was raised to 80° C. Thereafter, the inside of the polymerization vessel was evacuated to 48 kPa, followed by stirring, and distillation was carried out under reduced pressure for 5 hours while maintaining the temperature to 80° C. After cooling, hydrochloric acid was added to dissolve the calcium phosphate, followed by washing with water, filtration and disintegration to obtain wet toner particles. Here, the value of A/B was 0.1. After their production, how deposits had formed on the inner wall surface of the polymerization vessel was examined.

The particle size distribution, coefficient of number variation, moisture content, styrene and n-butyl acrylate residual monomers each in terms of toluene and total amount of organic volatile components of the wet toner particles were measured.

The results of the foregoing are shown in Tables 1 and 2.

The wet toner particles thus obtained were dried for 4 hours using a 100-liter volume, SV mixer type vacuum dryer (trade name: SV-001VT; manufactured by Shinko Panteck K.K.) under conditions of a wet-toner-particle feed quantity of 40 kg, a temperature of 50° C. and a degree of vacuum of 2.67 to 4.00 kPa to obtain toner particles. The moisture content and so forth of the toner particles having been dried were measured to obtain the results shown in Table 2.

To the toner particles thus obtained, the subsequent procedure of Example 1 was repeated to obtain a toner and a two-component developer, and images were reproduced to make evaluation in the same way. Various physical properties of the toner and the results of evaluation are shown in Table 3.

REFERENCE EXAMPLE 2

After the polymerization reaction carried out in the same manner as in Example 1 was completed, the heating from the jacket 4 was stopped, and then the steam feed valve 8 was opened to introduce pure saturated steam into the polymerization vessel at a rate of 500 kg per hour (steam pressure: 50 kPa; temperature: 81° C.). Maintaining the internal temperature of the polymerization vessel to 80° C. and after 3 hours, the steam feed valve 8 was closed, and then cooling water was made to flow into the jacket 4 to cool the contents of the polymerization container 12. Thereafter, hydrochloric acid was added to dissolve the calcium phosphate, followed by washing with water, filtration and disintegration to obtain wet toner particles. Here, the value of A/B was 0.15.

Using the above wet toner particles, toner particles, a toner and a two-component developer were obtained in the same manner as in Example 1. The results of measurement and evaluation on the respective items are shown in Tables 1 to 3.

REFERENCE EXAMPLE 3

Wet toner particles, toner particles, a toner and a two-component developer were obtained in the same manner as in Example 4 except that the steam feed time was changed to 1.5 hours. Here, the value of A/B was 0.15. The results of measurement and evaluation on the respective items are shown in Tables 1 to 3.

REFERENCE EXAMPLE 4

Wet toner particles were obtained in the same manner as in Example 4 except that the steam feed time was changed to 1.5 hours. Thereafter, how deposits had formed on the inner wall surface of the polymerization vessel was examined, and also the particle size distribution, coefficient of number variation, moisture content, styrene and n-butyl acrylate residual monomers each in terms of toluene and total amount of organic volatile components of the wet toner particles were measured. The results are shown in Tables 1 and 2.

The wet toner particles thus obtained were dried for 4 hours using a 100-liter volume, SV mixer type vacuum dryer (trade name: SV-001VT; manufactured by Shinko Panteck K.K.) under conditions of a wet-toner-particle feed quantity of 40 kg, a temperature of 50° C. and a degree of vacuum of 2.67 to 4.00 kPa to obtain toner particles. The moisture content and so forth of the toner particles having been dried were measured to obtain the results shown in Table 2.

To the toner particles thus obtained, the subsequent procedure of Example 1 was repeated to obtain a toner and a two-component developer, and images were reproduced to make evaluation in the same way. Various physical properties of the toner and the results of evaluation are shown in Table 3.

COMPARATIVE EXAMPLE 1

Particles of a polymerizable monomer composition which were obtained in the same manner as in Example 1 were put into a polymerization vessel 12A (FIG. 6), and polymerization reaction was carried out with stirring, at a temperature of 60° C. for 5 hours and further for 5 hours after the temperature was raised to 80° C. Thereafter, without introducing any saturated steam, hydrochloric acid was added to dissolve the calcium phosphate, followed by washing with water, filtration and disintegration to obtain wet toner particles. After their production, how deposits had formed on the inner wall surface of the polymerization vessel was examined.

The particle size distribution, coefficient of number variation, moisture content, styrene and n-butyl acrylate residual monomers each in terms of toluene and total amount of organic volatile components of the wet toner particles were measured.

The results of the foregoing are shown in Tables 1 and 2.

The wet toner particles thus obtained were dried for 4 hours using a 100-liter volume, SV mixer type vacuum dryer (trade name: SV-001VT; manufactured by Shinko Panteck K.K.) under conditions of a wet-toner-particle feed quantity of 40 kg, a temperature of 50° C. and a degree of vacuum of 2.67 to 4.00 kPa to obtain toner particles. The moisture content and so forth of the toner particles having been dried were measured to obtain the results shown in Table 2.

To the toner particles thus obtained, the subsequent procedure of Example 1 was repeated to obtain a toner and a two-component developer, and images were reproduced to make evaluation in the same way. Various physical properties of the toner and the results of evaluation are shown in Table 3.

COMPARATIVE EXAMPLE 2

Polymerization of particles of a polymerizable monomer composition, washing with water, filtration, drying and disintegration were carried out in the same manner as in Comparative Example 1 to obtain wet toner particles, except that the vacuum dryer SV-001VT was changed for a conical blender dryer (manufactured by Nippon Kansouki K.K.). After the production of the wet toner particles, how deposits had formed on the inner wall surface of the polymerization vessel was examined. The results are shown in Table 1.

Conditions for the drying carried out here using the conical blender dryer were as follows:
Type: Model CBD-300.
Volume: 0.3 $m^3$.
Feed quantity: 120 kg.
Temperature: 50° C.
Degree of vacuum: 2.67 to 4.00 kPa.
Drying time: 5 hours.

The moisture content and so forth of the toner particles having been dried were measured to obtain the results shown in Table 2.

To the toner particles thus obtained, the subsequent procedure of Example 1 was repeated to obtain a toner and a two-component developer, and images were reproduced to make evaluation in the same way. Various physical properties of the toner and the results of evaluation are shown in Table 3.

TABLE 1

| | Steam pressure (kPa) | Steam temperature (° C.) | Deposition on wall surface | Deposition on pipes | Steam flow rate (kg/H) | A/B |
|---|---|---|---|---|---|---|
| Example: | | | | | | |
| 1 | 205 | 120 | A | B | 500 | 0.60 |
| 2 | 500 | 151 | A | B | 500 | 0.70 |
| 3 | 115 | 103 | A | B | 500 | 0.40 |
| 4 | 205 | 120 | A | B | 300 | 0.30 |
| 5 | 205 | 120 | A | C | 300 | 0.60 |
| 6 | 205 | 120 | A | B | 800 | 1.10 |
| 7 | 205 | 120 | A | B | 500 | 0.60 |
| 8 | 205 | 120 | A | A | 500 | 0.60 |
| 9 | 205 | 120 | A | B | 500 | 0.60 |
| 10 | 205 | 120 | A | B | 500 | 0.55 |
| 11 | 205 | 120 | A | B | 500 | 0.65 |
| 12 | 205 | 120 | A | A | 500 | 0.55 |
| 13 | 205 | 120 | A | A | 500 | 0.60 |
| 14 | 205 | 120 | A | A | 500 | 0.52 |
| 15 | 205 | 120 | A | B | 500 | 0.60 |
| 16 | 205 | 120 | A | B | 800 | 1.10 |
| 17 | 205 | 120 | A | B | 300 | 0.30 |
| Reference Example: | | | | | | |
| 1 | — | — | C | — | 0 | 0.10 |
| 2 | 50 | 81 | A | B | 500 | 0.15 |
| 3 | 205 | 120 | A | B | 300 | 0.15 |
| 4 | 205 | 120 | A | B | 300 | 0.15 |
| Comparative Example: | | | | | | |
| 1 | — | — | C | — | 0 | 0.70 |
| 2 | — | — | C | — | 0 | 0.70 |

TABLE 2

| | Wet toner particles | | | | | | Toner particles | | | |
|---|---|---|---|---|---|---|---|---|---|---|
| | Weight = average particle diameter (μm) | Coefficient of number variation (%) | Moisture content (%) | Total amount of organic volatile components (ppm) | Residual St (ppm) | Residual BA (ppm) | Moisture content (%) | Total amount of organic volatile components (ppm) | Residual St (ppm) | Residual BA (ppm) |
| Example: | | | | | | | | | | |
| 1 | 7.0 | 23 | 20 | 180 | 15 | 0 | 0.2 | 170 | 14 | 0 |
| 2 | 7.3 | 26 | 20 | 150 | 13 | 0 | 0.2 | 145 | 12 | 0 |
| 3 | 7.0 | 23 | 20 | 250 | 21 | 0 | 0.2 | 240 | 20 | 0 |
| 4 | 7.0 | 23 | 20 | 350 | 29 | 1 | 0.2 | 335 | 28 | 1 |
| 5 | 7.6 | 29 | 20 | 250 | 21 | 0 | 0.2 | 240 | 20 | 0 |
| 6 | 7.2 | 25 | 20 | 160 | 13 | 0 | 0.2 | 150 | 13 | 0 |
| 7 | 7.0 | 23 | 20 | 175 | 15 | 0 | 0.2 | 165 | 14 | 0 |
| 8 | 7.0 | 23 | 20 | 180 | 15 | 0 | 0.2 | 170 | 14 | 0 |

TABLE 2-continued

| | Wet toner particles | | | | | | Toner particles | | | |
|---|---|---|---|---|---|---|---|---|---|---|
| | Weight = average particle diameter (μm) | Coefficient of number variation (%) | Moisture content (%) | Total amount of organic volatile components (ppm) | Residual St (ppm) | Residual BA (ppm) | Moisture content (%) | Total amount of organic volatile components (ppm) | Residual St (ppm) | Residual BA (ppm) |
| 9 | 7.0 | 23 | 20 | 180 | 15 | 0 | 0.2 | 170 | 14 | 0 |
| 10 | 7.3 | 26 | 20 | 190 | 16 | 0 | 0.2 | 185 | 15 | 0 |
| 11 | 7.0 | 23 | 20 | 175 | 15 | 0 | 0.2 | 168 | 14 | 0 |
| 12 | 7.1 | 24 | 20 | 190 | 16 | 0 | 0.2 | 185 | 15 | 0 |
| 13 | 7.0 | 23 | 20 | 180 | 15 | 0 | 0.2 | 170 | 14 | 0 |
| 14 | 7.2 | 25 | 20 | 195 | 16 | 0 | 0.2 | 190 | 15 | 0 |
| 15 | 7.2 | 23 | 25 | 300 | 25 | 1 | 0.5 | 250 | 24 | 1 |
| 16 | 7.5 | 26 | 25 | 200 | 17 | 0 | 0.5 | 180 | 16 | 0 |
| 17 | 7.2 | 23 | 25 | 400 | 33 | 1 | 0.5 | 350 | 32 | 1 |
| Reference Example: | | | | | | | | | | |
| 1 | 7.0 | 23 | 21 | 600 | 270 | 10.6 | 0.2 | 200 | 95 | 4 |
| 2 | 7.0 | 23 | 20 | 590 | 270 | 11 | 0.2 | 580 | 260 | 11 |
| 3 | 7.0 | 23 | 20 | 550 | 230 | 10 | 0.2 | 540 | 220 | 10 |
| 4 | 7.0 | 23 | 20 | 550 | 230 | 10 | 0.2 | 300 | 150 | 7 |
| Comparative Example: | | | | | | | | | | |
| 1 | 7.0 | 23 | 22 | 1,300 | 950 | 41 | 0.3 | 700 | 400 | 17 |
| 2 | 7.0 | 23 | 22 | 1,400 | 1,100 | 48 | 0.3 | 750 | 450 | 20 |

t: styrene,
BA: n-butyl acrylate

TABLE 3

| | Toner | | | Toner | | | | | |
|---|---|---|---|---|---|---|---|---|---|
| | Weight = average particle diameter (μm) | Coefficient of number variation (%) | Average circularity | Moisture content (%) | Total amount of organic volatile components (ppm) | Residual St (ppm) | Residual BA (ppm) | Fog | Image density |
| Example: | | | | | | | | | |
| 1 | 7.0 | 23 | 0.97 | 0.2 | 168 | 14 | 0 | A | 1.4 |
| 2 | 7.3 | 26 | 0.98 | 0.2 | 144 | 12 | 0 | A | 1.4 |
| 3 | 7.0 | 23 | 0.97 | 0.2 | 238 | 20 | 0 | A | 1.3 |
| 4 | 7.0 | 23 | 0.97 | 0.2 | 332 | 28 | 1 | A | 1.3 |
| 5 | 7.6 | 29 | 0.98 | 0.2 | 238 | 20 | 0 | A | 1.2 |
| 6 | 7.2 | 25 | 0.98 | 0.2 | 149 | 13 | 0 | A | 1.3 |
| 7 | 7.0 | 23 | 0.97 | 0.2 | 163 | 14 | 0 | A | 1.4 |
| 8 | 7.0 | 23 | 0.97 | 0.2 | 168 | 14 | 0 | A | 1.4 |
| 9 | 7.0 | 23 | 0.97 | 0.2 | 168 | 14 | 0 | A | 1.4 |
| 10 | 7.3 | 26 | 0.97 | 0.2 | 183 | 15 | 0 | A | 1.4 |
| 11 | 7.0 | 23 | 0.97 | 0.2 | 166 | 14 | 0 | A | 1.4 |
| 12 | 7.1 | 24 | 0.97 | 0.2 | 183 | 15 | 0 | A | 1.4 |
| 13 | 7.0 | 23 | 0.97 | 0.2 | 168 | 14 | 0 | A | 1.4 |
| 14 | 7.2 | 25 | 0.97 | 0.2 | 188 | 15 | 0 | A | 1.4 |
| 15 | 7.2 | 23 | 0.97 | 0.5 | 248 | 24 | 1 | A | 1.4 |
| 16 | 7.5 | 26 | 0.98 | 0.5 | 178 | 16 | 0 | A | 1.5 |
| 17 | 7.2 | 23 | 0.97 | 0.5 | 347 | 32 | 1 | A | 1.1 |
| Reference Example: | | | | | | | | | |
| 1 | 7.0 | 23 | 0.97 | 0.2 | 198 | 94 | 4 | C | 1.0 |
| 2 | 7.0 | 23 | 0.97 | 0.2 | 574 | 258 | 11 | D | 1.0 |
| 3 | 7.0 | 23 | 0.97 | 0.2 | 535 | 218 | 10 | D | 1.0 |
| 4 | 7.0 | 23 | 0.98 | 0.2 | 297 | 149 | 7 | C | 1.0 |
| Comparative Example: | | | | | | | | | |
| 1 | 7.0 | 23 | 0.97 | 0.3 | 693 | 396 | 17 | D | 0.7 |
| 2 | 7.0 | 23 | 0.97 | 0.3 | 743 | 446 | 20 | D | 0.6 |

St: styrene,
BA: n-butyl acrylate

What is claimed is:

1. A process for producing toner particles which comprises a polymerization step of polymerizing a polymerizable monomer composition containing at least a polymerizable monomer, in a vessel holding therein an aqueous medium, wherein;

a high temperature saturated steam with a temperature higher than 100° C. is introduced into the aqueous medium held in the vessel, at the latter half of polymerization or after the polymerization has been completed, to remove at least organic volatile components from toner particles having at least a binder resin and a colorant, said saturated steam introduced into the polymerization vessel has a temperature of from 105° C. to 180° C. and is at a pressure P (kPa) of:

$$126.6 \leqq P \leqq 1{,}013.3.$$

2. The process for producing toner particles according to claim 1, wherein said saturated steam is so introduced that the quantity of the contents held in the polymerization vessel after the saturated steam has been introduced comes larger than the quantity of the contents held therein at the latter half of polymerization or after the polymerization has been completed.

3. The process for producing toner particles according to claim 1, wherein quantity A of contents distilled off from the polymerization vessel and quantity B of contents in the polymerization vessel at the latter half of polymerization or after the polymerization has been completed fulfill the following condition:

$$0.2 < A/B < 2.$$

4. The process for producing toner particles according to claim 1, wherein quantity A of contents distilled off from the polymerization vessel and quantity B of contents in the polymerization vessel at the latter half of polymerization or after the polymerization has been completed fulfill the following condition:

$$0.5 < A/B < 1.5.$$

5. The process for producing toner particles according to claim 1, wherein the total amount of organic volatile components contained in the toner, in terms of toluene based on the weight of the toner is made to be 500 ppm or less, according to the analysis of the organic volatile components by the head space method at a heating temperature of 150° C.

6. The process for producing toner particles according to claim 5, wherein the total amount of organic volatile components contained in the toner, in terms of toluene is made to be 400 ppm or less.

7. The process for producing toner particles according to claim 5, wherein the total amount of organic volatile components contained in the toner, in terms of toluene is made to be 300 ppm or less.

8. The process for producing toner particles according to claim 1, wherein said saturated steam is pure saturated steam.

9. The process for producing toner particles according to claim 1, wherein a feed pipe through which said saturated steam is introduced is, at its part inside said vessel, entirely in said aqueous medium.

10. The process for producing toner particles according to claim 1, wherein at least two saturated steam feed pipes are provided.

11. The process for producing toner particles according to claim 1, wherein stirring blade peripheral speed C (m/s) in said vessel is:

$$0.5 < C < 5.$$

12. The process for producing toner particles according to claim 1, wherein a saturated steam feed pipe and a tangent line of a cylindrical part of the vessel falls at an angle a of:

$$5° \leqq \alpha \leqq 80°.$$

13. The process for producing toner particles according to claim 1, wherein a saturated steam feed pipe and a horizontal plane of the vessel falls at an angle β of:

$$5° \leqq \beta \leqq 90°.$$

14. The process for producing toner particles according to claim 1, wherein the toner particles in said aqueous medium have been covered with a particulate inorganic dispersion stabilizer.

15. The process for producing toner particles according to claim 1, wherein said toner particles has a glass transition point of from 55° C. to 80° C.

16. The process for producing toner particles according to claim 1, wherein the aqueous medium into which the high temperature saturated steam has been introduced has a liquid temperature of from 95° C. to 105° C.

17. The process for producing toner particles according to claim 1, wherein said polymerizable monomer is a vinyl monomer selected from the group consisting of styrene, a styrene derivative, an acrylate, a methacrylate copolymer and a mixture of any of these, and the vinyl monomer is removed from said toner particles so that the vinyl monomer contained in said toner particles is in a residue of 75 ppm or less.

18. The process for producing toner particles according to claim 17, wherein the vinyl monomer is removed from said toner particles so that the vinyl monomer contained in said toner particles is in a residue of 50 ppm or less.

19. The process for producing toner particles according to claim 1, wherein a polymerization initiator is used in said polymerization step.

* * * * *

UNITED STATES PATENT AND TRADEMARK OFFICE

CERTIFICATE OF CORRECTION

PATENT NO. : 6,835,521 B2
DATED : December 28, 2004
INVENTOR(S) : Yoshinori Tsuji et al.

It is certified that error appears in the above-identified patent and that said Letters Patent is hereby corrected as shown below:

Title page,
Item [56], References Cited, OTHER PUBLICATIONS, "Brandrup, et al.;" reference, "temperatures" should read -- Temperatures --.

Colunm 1,
Line 23, "productions," should read -- production --.

Column 2,
Line 22, "more placed on" should read -- placed more on the --.

Column 7,
Line 61, "tend" should read -- tends --.

Column 8,
Line 1, "βshown" should read -- β shown --; and
Line 5, "90β" should read -- 90º --.

Column 9,
Line 39, "deoxydation," should read -- deoxidation, --; and
Line 40, "was." should read -- wax. --.

Column 12,
Line 54, "(Y3$Fe_5O_{12}$)," should read -- ($Y_3Fe_5O_{12}$), --; and
Line 55, "(Gd3$Fe_5O_{12}$)," should read -- ($Gd_3Fe_5O_{12}$), --.

Column 13,
Line 24, "generating" should read -- generate --.

Column 17,
Line 26, "Nikkaki k.k.)" should read -- Nikkaki K.K. --.

Column 19,
Line 28, "complicate" should read -- complicated --.

Column 22,
Line 22, "was" should read -- were --.

Column 25,
Line 38, "CaC12" should read -- $CaC1_2$ --.

UNITED STATES PATENT AND TRADEMARK OFFICE

CERTIFICATE OF CORRECTION

PATENT NO. : 6,835,521 B2
DATED : December 28, 2004
INVENTOR(S) : Yoshinori Tsuji et al.

It is certified that error appears in the above-identified patent and that said Letters Patent is hereby corrected as shown below:

Column 31,
Table 2, “t: styrene,” should read -- St: styrene, --.

Column 33,
Line 6, “wherein;” should read -- wherein: --; and
Line 21, “comes” should read -- becomes --.

Column 34,
Lines 9, 18 and 24, “saturated steam” should read -- saturated-steam --;
Line 12, “stirring blade” should read -- stirring-blade --;
Line 19, “angle a” should read -- angle α --;
Line 34, “has” should read -- have --; and
Line 37, “high” should read -- high- --.

Signed and Sealed this

Twenty-fourth Day of May, 2005

JON W. DUDAS
*Director of the United States Patent and Trademark Office*